US007212095B2

(12) United States Patent
Sato et al.

(10) Patent No.: US 7,212,095 B2
(45) Date of Patent: May 1, 2007

(54) INDUCTIVE ELEMENT AND MANUFACTURING METHOD OF THE SAME

(75) Inventors: Shinichi Sato, Tokyo (JP); Hitoshi Ohkubo, Tokyo (JP); Toshiaki Kikuchi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/773,318

(22) Filed: Feb. 9, 2004

(65) Prior Publication Data

US 2005/0174208 A1 Aug. 11, 2005

(51) Int. Cl.
*H01F 5/00* (2006.01)

(52) U.S. Cl. ..... 336/200; 336/83; 336/223

(58) Field of Classification Search ..... 336/200, 336/232, 223, 83; 29/602.1
See application file for complete search history.

(56) References Cited

U.S. PATENT DOCUMENTS

| | | | | |
|---|---|---|---|---|
| 3,614,554 | A * | 10/1971 | Shield et al. | 257/531 |
| 4,729,510 | A * | 3/1988 | Landis | 333/162 |
| 6,223,422 | B1 * | 5/2001 | Takeuchi et al. | 29/607 |
| 6,249,206 | B1 * | 6/2001 | Uchikoba et al. | 336/200 |
| 6,362,716 | B1 * | 3/2002 | Anbo et al. | 336/200 |
| 6,531,945 | B1 * | 3/2003 | Ahn et al. | 336/200 |
| 6,535,093 | B1 * | 3/2003 | Murata et al. | 336/83 |
| 6,580,350 | B1 * | 6/2003 | Kobayashi | 336/200 |
| 6,614,093 | B2 * | 9/2003 | Ott et al. | 257/531 |
| 6,791,444 | B1 * | 9/2004 | Masuda et al. | 336/83 |
| 2002/0105406 | A1 * | 8/2002 | Liu et al. | 336/200 |

FOREIGN PATENT DOCUMENTS

| | | | |
|---|---|---|---|
| JP | 07037712 | A * | 2/1995 |
| JP | 2714343 | | 10/1997 |
| JP | 10-270255 | | 10/1998 |
| JP | 11-103229 | | 4/1999 |
| JP | 11-154611 | | 6/1999 |
| JP | 11-204352 | | 7/1999 |
| JP | 2003-197427 | | 7/2003 |

OTHER PUBLICATIONS

Merriam-Webster's Collegiate Dictionary, 10th Edition, copyright 2001, p. 513.*

* cited by examiner

*Primary Examiner*—Anh Mai
(74) *Attorney, Agent, or Firm*—Oblon, Spivak, McClelland, Maier & Neustadt, P.C.

(57) ABSTRACT

Conductor layers 2A and insulating layers 4A are alternately stacked so as to prepare a base material 17. A plurality of grooves 18 having a predetermined width are formed in a surface of the base material 17 in such a manner that these plural grooves 18 are located parallel to each other along a stacking layer direction in order to form a coil inner peripheral portion. Embedding materials 5 are filled into the grooves 18. Surfaces 16 of the base material into which the embedding materials 5 have been filled are flattened by polishing. The conductor layers 2A located adjacent to each other are connected to each other, so that helical coils which constitute inductive elements are constructed. Then, both the front plane and the rear plane of the resultant base material are covered by an insulating layer, which is cut so as to obtain respective chips.

14 Claims, 19 Drawing Sheets

INDUCTIVE ELEMENT AND MANUFACTURING METHOD OF THE SAME

BACKGROUND OF THE INVENTION

The present invention is related to an inductive element and a method of manufacturing the inductive element which is used as an inductor device having a stacked layer structure, a common mode choke coil, or a transformer. Otherwise, this inductive element may be constituted in combination with other elements, or may be used in such a mode that this inductive element is assembled in a module.

As one example of conventional inductive elements, spiral-shaped coils are formed by using a photolithography method on both a front surface and a rear surface of a core substrate, while the core substrate is made of either resin or a composite material manufactured by mixing functional material powder with resin (see, for example, Japanese Patent No. 2714343 (Particularly, pages 3 to 4, FIGS. 3 and 5).

Also, as another prior art, a stacked layer ceramics chip inductor is typically known. That is, since plural layers of green seats having conductor patterns wound by ½-turn to ¾-turns are stacked and the stacked multilayers are cut to be sintered, helical-shaped coils are wound up along the stacking direction (see, for example, Japanese Patent Publication No. HEI-11-103229 (Particularly, pages 4 to 5, FIG. 2).

Furthermore, as another conventional inductive element, there is a winding type inductive element. This conventional winding type inductive element is manufactured by winding a wire on a bobbin in a helical shape, while this wire constitutes a winding (see, for instance, Japanese Patent Publication No. HEI-11-204352 (Particularly, page 3, FIG. 2).

Also, as this sort of inductive element, a composite material made of both ferrite powder and resin is employed as an insulating base (see, for example, Japanese patent Publication No. HEI-10-270255 (pages 3 to 5, FIGS 1 and 2) and Japanese Patent Publication No. HEI-11-154611 (pages 4 to 6, FIGS. 1 and 2).

The conventional inductive element using the above-described thin-film type coil can hardly obtain a high Q characteristic (Q-factor) in view of the own construction of this conventional inductive element. Also, since the spiral coils are formed on the same planes of the core substrate, very fine processing is highly required for the conductor patterns, so that higher inductance values can be hardly realized. Also, in order to form the spiral coils, the patterning operations are required at least two times by employing the photolithography method. Therefore, there is such a problem that a total number of manufacturing stages is increased.

Also, as to the above-described stacked layer type inductive element, since the internal conductors are stacked in the multilayer form by employing the printing method, both printing fluctuation and stacking fluctuation occur. In addition, since the stacked layer type inductive element is sintered, the inductance precision is lowered due to shrinkage of the element and shrinkage fluctuation while this element is sintered. Thus, such an inductive element having narrow tolerance can be hardly manufactured.

Furthermore, because the sintered conductor patterns form a coil, it is difficult to obtain a high Q-factor.

Also, as to the above-explained winding type inductive element, since the wires are wound on the respective bobbins one by one, this winding type inductive element can be hardly made compact, and the better productivity thereof cannot be achieved, so that such a winding type inductive element can be hardly manufactured at a lower cost.

To solve the above-described problems, it is proposed another type of inductive element in Japanese Patent Publication 2003-197427. That is, through holes are formed in the form of two columns in a first layer which is made of either resin or such a composite material manufactured by mixing functional material powder with resin. A helical-shaped coil is constituted by a conductor which communicates between through holes formed in the different columns on the upper and lower planes of the first layer.

With employment of such an inductive element structure, the conductor patterns can be realized by way of a step capable of forming patterns in high precision such as a photolithography method. In addition, since the conductor pattern is formed on the flat portion of the first layer (core substrate), the positioning precision of the conductor patterns can be improved, and there is less characteristic fluctuation which is caused by shifts of the patterns when the patterns are stacked in the multilayer form. As a result, the narrow tolerance as to the electric characteristic can be achieved. Also, in this inductive element, the helical coil is not constructed in the stacking stage, but the helical-shaped coil is constituted by forming the plain conductor patterns. As a result, the helical-shaped coil can be constituted within a short time. Thus, the devices having the narrow tolerance as to the electric characteristic can be produced with low cost.

However, in this inductive element described in the prior patent application, the through holes must be formed in the core substrate by using laser or the like. If a depth of this through hole is larger than, or equal to approximately 0.3 mm, then the following problem occurs. That is, such a through hole whose diameter is approximately 0.02 mm can be hardly formed. Moreover, the through holes having the uniform sectional areas along the penetration direction of the through holes, and the conductors can be hardly filled/formed. Also, there is another problem that such through holes having the well-matched shapes can be hardly formed.

SUMMARY OF THE INVENTION

The present invention has been made to solve the above-described problems of the conventional inductive elements, and therefore, has an object to provide an inductive element and a method for manufacturing such an inductive element which can be easily mass-produced, and by which an inductance value of narrow tolerance can be obtained, while a shift in conductor patterns can be reduced. Also, the present invention owns another object to provide an inductive element capable of achieving a high Q characteristic and a method of manufacturing the inductive element having the high Q characteristic.

(1) An inductive element, according to the present invention, includes a stacked layer member in which an insulating layer and a conductor layer are alternately stacked; a coil which is formed by U-shaped conductors constituted by cutting the conductor of the stacked layer member in U-shapes; an embedding material filled in a groove formed by cutting the conductor of the stacked layer member; and bridge conductors formed on the embedding material which is embedded in the groove by way of a photolithography method in such a manner that opening sides of the U-shaped conductors formed by cutting the conductor of the stacked layer member are connected to each other.

In accordance with the inductive element of the present invention, since the U-shaped conductors of the coils are formed by cutting the stacked layer member, such inductive elements having the narrow tolerance can be obtained under such a condition that the shapes of these coils are matched to each other, there is no positional fluctuation among the U-shaped conductors, there is no fluctuation among the stacked layers, and the inductance values of these coils are matched with each other. Also, the conductors which become the helical coils are processed within one time by cutting the stacked base material. As a result, the helical coils can be manufactured in the easy manner, and the inductive elements can be manufactured at a lower cost.

As the base material used in the present invention, various sorts of materials may be employed, for instance, an insulating material is coated on a metal foil in a film manner; both a metal film and a seat (ceramics substrate, resin substrate, or substrate made of composite material by mixing functional material powder into resin) made of an insulating material are formed in an integral manner; and such a material that conductor paste is coated to a green seat employed in a thick film technique, the paste-coated green seat is dried, and then, the dried paste-coated green seats are stacked to be sintered.

(2) Also, an inductive element of the present invention is featured by that the U-shaped conductors are connected by the bridge conductor by skipping one of the U-shaped conductors so as to form two sets of rectangular helical coils.

As previously explained, since the two helical coils are arranged in the above-described manner and the terminal electrodes corresponding to the respective helical coils are provided, a choke coil and a transformer may be constituted which own the above-described feature.

(3) In the inductive element of the present invention, either the insulating layer or the embedding material is made of either inorganic or organic material, or a composite material which may be preferably made by mixing functional material powder (either magnetic powder or dielectric powder) into the resin. If the insulating layer and the embedding material are formed by the resin, or the composite material thereof in the above-described manner, then the inductive element can be readily processed. Also, since the sort of composite material is varied, inductive elements having arbitrary characteristics can be obtained.

(4) In the inductive element of the present invention, the U-shaped conductor is made of either a metal plate or a metal foil; and the bridge conductor may be preferably formed by a photolithography method. As previously explained, while either the metal plate or the metal foil is employed as the U-shaped conductor, when the conductor formed by way of the photolithography method is employed as the bridge conductor, the resistivity of the coil can be suppressed to the lower value. As a result, the DC resistance can be lowered and the higher Q characteristic can be obtained.

(5) In the inductive element of the present invention, the bridge conductor may be preferably formed on a flattened surface of both an opening edge of the U-shaped conductor and the embedding material which has been embedded in the groove. As explained above, since the planes where the U-shaped conductors are formed are matched by being polished, the edge portions of the U-shaped conductors can be connected to the bridge conductors under better condition, and further, the coil shapes can be made coincident with each other.

(6) In the inductive element of the present invention, the inductive element has an insulating layer which covers a peripheral portion of the coil; at least one of the insulating layer and the embedding material is constructed of a magnetic material; and the insulating layer between the coil conductors may be preferably made of a dielectric material with low permittivity. With employment of this structure, such inductive elements having the higher inductance values can be obtained.

(7) A manufacturing method of an inductive element, according to the present invention, includes the steps of: preparing a rectangular plate-shaped base material which contains a number of conductor layers corresponding to a turn number of plural inductive elements within a width along a stacking layer direction, while the conductor layers and insulating layers are alternately stacked, the rectangular plate-shaped base material owns a thickness equivalent to one piece of the inductive element; forming a plurality of grooves having a predetermined width in surfaces of the base material in such a manner that the plural grooves are positioned parallel to each other along the stacking layer direction so as to form a coil inner peripheral portion; embedding filler materials into the grooves; flattening the surfaces of the base material into which said embedding materials have been embedded; forming bridge conductors by way of a photolithography method, which are connected between adjoining conductor layers in such a manner that the bridge conductors bridge over the embedding materials on the plane so as to constitute rectangular helical coils which constitute the inductive elements; covering both the front plane and the rear plane of the base material to which the bridge conductors have been applied by an insulating material; forming external terminals corresponding to the respective rectangular helical coils on the front plane; and cutting the base material along longitudinal and lateral directions, whereby chips which constitute the respective inductive elements are obtained.

As previously explained, the U-shaped conductors of the coils are formed by cutting the grooves of the stacked-layer member made by stacking the conductor layers and the insulating layers, and also by cutting the base material so as to form the respective chips. As a consequence, such inductive elements having the narrow tolerance can be obtained under such a condition that the shapes of these internal coils are matched to each other, there is no positional fluctuation among the U-shaped conductors, there is no fluctuation among the stacked layers, and the inductance values of these coils are matched with each other. Also, the conductors which become the helical coils are processed within one time by cutting the stacked base material. As a result, the helical coils can be manufactured in the easy manner, and the inductive elements can be manufactured at a lower cost.

(8) In the manufacturing method of the inductive element according to the present invention, slits are formed among the grooves into which the filling materials have been embedded before the cutting process operation is carried out, and insulating materials are filled into the respective slits; and portions of the respective filled insulating materials may be preferably cut by a cutting means which is narrower than a width of the insulating material.

As explained in this example, while the slits are formed in the cutting regions among the grooves, where the chips are arrayed in the column form, the insulating materials are filled into these slits. Then, if the center portions of these filled insulating materials are cut by employing the cutting means, then the chips in which both side planes of the respective chips have been covered by the insulating materials can be formed at the same time when the center portions are cut. Thus, such a post-staged process operation for applying the insulating materials to the side surfaces of the chips is no longer required, and the chips can be manufactured in a higher efficiency.

(9) In the manufacturing method of the inductive element according to the present invention, both the front plane and the rear plane of the base material are covered by an insulating material, and at the same time, the insulating material may be preferably filled into the slits.

As previously described, since the filling operation of the insulating material into the slits and the coating operation of the insulating material onto the front/rear planes of the base material are carried out at the same time, a total number of the manufacturing steps can be reduced.

(10) In the manufacturing method of the inductive element according to the present invention, an insulating material is coated on either a band-shaped metal plate or a band-shaped metal foil, which has a width corresponding to the plurality of inductive elements and constitutes the conductor layer; the coated band-shaped base material is cut in a width corresponding to the plurality of inductive elements so as to obtain seat-shaped base materials; a plurality of the seat-shaped base materials are stacked so as to be formed in an integral form, which own a conductor layer number equivalent to a turn number of the plural inductive elements; and the integrally-formed stacked layer member is cut along a stacking layer direction at a width corresponding to a thickness of one piece of the inductive element, whereby the base material may be preferably obtained.

As explained above, in the case that the base material having the stacked layer structure is obtained, since the materials equivalent to a plurality of chip thicknesses are obtained at the same time to be cut, a total forming step number of the stacked member having a larger manufacturing step can be decreased.

(11) In the manufacturing method of the inductive element according to the present invention, in the case that either the metal plates or the metal foils are stacked to which the insulating material has been coated, while such band-shaped base materials having a thickness equivalent to the conductor layer number as to one piece of the inductive element are defined as one set, an insulating layer having a thickness thicker than the thickness of the insulating layer between the conductor layers may be preferably interposed between one set of the band-shaped base materials so as to be formed in an integral form.

As explained above, in the case that the base material having the stacked layer structure is obtained, since the portion to be cut is previously arranged as the insulating layer having the thicker thickness, the insulating layers formed on both edge planes of the coil along the winding center direction can be formed at the same time by cutting the base material to obtain the respective chips, so that a total manufacturing step can be reduced.

(12) Also, the manufacturing method of the inductive element, according to the present invention, may be featured by that in the case that the helical coils are formed, the bridge conductors are connected by skipping one of the bridge conductors with respect to the U-shaped conductor so as to form two pieces of the helical coils per a single chip.

As explained above, since two sets of the helical coils are obtained, a choke coil and a transformer can be obtained.

(13) Further, the U-shaped conductors, which is independent from each other, may be manufactured by slit machining, bridge conductors maybe formed by photolithography technique, and insulating layers are formed above and below the substance. The manufacturing processes may be varied for applicable the devices.

Moreover, a chip-array component having plural chip elements can be produces if the cutting portions are suitably adjusted.

(14) An inductive element, according to the present invention, includes either a core substrate or a stacked core substrate, a plurality of U-shaped conductors being formed along longitudinal and lateral directions on a surface of the core substrate in such a manner that opening sides of the U-shaped conductors are directed to one direction, and core substrates being stacked in the stacked core substrate in such a manner that a plurality of ladder-shaped conductors are provided side by side on surfaces of the core substrates; the inductive element includes: a plurality of U-shaped conductors formed inside an insulating member having a rectangular solid shape, which is cut out from said stacked core substrate; bridge conductors which are formed in a cutting plane formed by cutting the stacked core substrate by exposing opening edges of the U-shaped conductors, and which are formed in order to be connected among the respective U-shaped conductors; and an insulating layer formed on the cutting plane in such a manner that the insulating layer covers the bridge conductors; and wherein: a rectangular helical coil is formed by the U-shaped conductor and the bridge conductor.

As described above, in accordance with the inductive element of the present invention, since the U-shaped conductors are formed on the same plane of the core substrate within one time, the restrictions given to the conductor lengths and the sectional areas can be mitigated, so that the narrower conductor patterns can be formed. Also, the inductive elements can be manufactured in a higher efficiency, as compared with such a case that the through holes are formed. As a consequence, it is possible to provide the inductive elements at a lower cost by being manufactured in an easy manner. Also, since the coils are formed in the helical shapes, the Q-factors thereof can be increased.

Also, according to the present invention, there are free degrees as to the element structures and the manufacturing methods, while either the organic material or the inorganic material can be employed as the usable materials, or the composite material made of the organic material and the inorganic material may be employed as the usable materials. Also, the inductive elements having the high-performance electric characteristics optimized to the use purposes can be obtained.

(15) Also, the inductive element of the present invention is featured by that the U-shaped conductors are connected by said bridge conductor by skipping one of the U-shaped conductors so as to form two sets of rectangular helical coils.

As previously explained, since the two helical coils are arranged in the above-described manner and the terminal electrodes corresponding to the respective helical coils are provided, a choke coil and a transformer may be constituted which own the above-described feature.

(16) Also, the inductive element of the present invention is featured by that the U-shaped conductors of each of the layers are coaxially formed in a multiple manner; such U-shaped conductors having the same sizes, which are located adjacent to each other along a stacking layer direction, are connected to each other by the bridge conductors; and among the U-shaped conductors which are located adjacent to each other along inner/outer directions, such U-shaped conductors located on the same side portions along the stacking larger direction, or the opposite side portions along the stacking layer direction are connected to each other by the bridge conductors, whereby rectangular helical coils are formed in a multiple manner.

As previously explained, if the helical coils are coaxially constructed in the multiple manner, then the total winding number of the helical coils can be increased, and the inductive elements having the high inductances values can be obtained.

(17) Also, the inductive element of the present invention is featured by that both the insulating member and the insulating layer are made of either resin or a composite material made by mixing functional material powder into the resin.

In the present invention, ceramics and the like may be employed as the core substrate which constitutes the above-explained insulating member. Alternatively, since a base body having a low dielectric constant is constituted, as the insulating member and the insulating layer if either the resin or the composite material obtained by mixing the functional material powder in the resin is employed, then such a base body having a high self-resonance frequency may be obtained, and the processing operation thereof may be easily carried out. Also, since the functional material powder is selected, various inductive elements having various characteristics may be obtained which are adapted to industrial purposes.

(18) In the inductive element of the present invention, both the U-shaped conductors and said bridge conductors may be preferably formed by way of a photo lithography method. Since the helical coil is constituted by employing such a conductor, the inductive element having the high Q-factor and the low resistivity can be provided.

(19) A manufacturing method of an inductive element, according to the present invention, comprising the steps of: forming a plurality of U-shaped conductors corresponding to three sides of plural rectangular helical coils on surfaces of a core substrate in such a manner that opening edges of the U-shaped conductors are arrayed along longitudinal and lateral directions so as to be directed to the same direction; stacking plural sheets of the core substrates to be formed in an integral form so as to constitute a stacked core substrate; cutting the stacked core substrate in such a manner that said opening edges of the U-shaped conductors are exposed; forming bridge conductors for connecting the opening edges to each other by way of a photolithography method on a cutting plane where the opening edges of said U-shaped conductors are exposed so as to form the rectangular helical coils; forming an insulating layer for covering the bridge conductors on the cutting plane on which the bridging conductors have been formed; and cutting the base material into respective chips so as to obtain the inductive elements.

As explained above, in accordance with the manufacturing method of the inductive element of the present invention, the restrictions as to the conductor lengths and the sectional areas of the conductors can be further mitigated. Also, the manufacturing cost can be reduced, the Q characteristic can be improved, and the inductive characteristics suitably adapted to the use fields can be acquired.

(20) Also, the manufacturing method of the inductive element, according to the present invention, in that after a stick-shaped base material in which U-shaped conductors equivalent to plural pieces of the inductive elements are built is obtained by cutting the stacked core substrate in such a manner that the opening edges of the coil conductors are exposed, forming operation of the bridge conductors are carried out.

When the stick-shaped base material containing the U-shaped conductors is manufactured, the three sides of each of the layers of the helical coils can be formed within one time. As a consequence, the inductive elements can be manufactured in a higher efficiency and at a lower cost, as compared with the above-described case that the inductive elements are manufactured with the through holes.

(21) Also, the manufacturing method of the inductive element, according to the present invention, in that in the case that the core substrate is stacked, such core substrates having turn numbers equivalent to a thickness of the plural pieces of inductive elements are stacked to be formed in an integral form; after a plate-shaped base material in which the U-shaped conductors having such a width along the stacking layer direction, corresponding to plural pieces of the inductive elements, have been built is obtained by cutting the stacked core substrate in such a manner that the opening edges of the coil conductors are exposed, forming operation of the bridge conductors is carried out.

As previously explained, while the plate-shaped base material is obtained in which the U-shaped conductors constituting a plurality of inductive elements have been built along the longitudinal and lateral directions as the base material instead of the stick-shaped base material, if the bridge conductors are formed on this plate-shaped base material, then the inductive elements can be manufactured in a higher efficiency, and the manufacturing cost can be further lowered.

(22) Also, the manufacturing method of the inductive element, according to the present invention, in that conductor layers which constitute both edge plane portions of terminal electrodes of the inductive elements are provided on both edge planes of the stacked core substrate along a stacking layer direction.

As explained above, if the conductor layers which constitute the both edge plane portions of the terminal electrodes are previously formed on both edges of the stacked core substrate, then the terminal electrodes can be readily formed on the edge plane portions of the terminal electrodes. As a result, in the case that the inductive elements are mounted on a printed circuit board by way of a soldering manner, these inductive elements can be fixed to the predetermined positions under stable condition, since the solder is raised up to the edge plane portions due to surface tension.

(23) Also, the manufacturing method of the inductive element, according to the present invention, in that the conductor layers which constitute both the edge plane portions of the terminal electrodes of the inductive elements are provided on both the edge planes of the stacked core substrate along the stacking layer direction, and also, a portion which constitutes a boundary between the inductive elements.

As explained above, in such a case that the bridge conductors are formed after the plate-shaped base material has been obtained, since the conductor layers are provided on the boundary between the regions which constitute the inductive elements, the edge plane portions of the terminal electrodes can be formed by cutting this conductor layer portion at the center thereof.

(24) Also, the manufacturing method of the inductive element, according to the present invention, in that when the stacked core substrate is cut, the cutting operation is carried out in such a manner that insulating layers are simultaneously formed around the three sides of the U-shaped conductors.

As explained above, since the base material is cut, the insulating layers of the three planes around the U-shaped conductor are formed. As a result, the coating steps for lately coating these insulating layers with respect to the three planes can be omitted. Thus, the inductive elements can be manufactured in a high efficiency, and the manufacturing cost can be reduced.

(25) Also, the manufacturing method of the inductive element, according to the present invention, in that instead of the core substrate on which the U-shaped conductors have been formed, such a core substrate on which plural columns of ladder-shaped conductors have been formed is employed as the core substrate; and the stacked core substrate is cut along a direction perpendicular to a longitudinal direction of the ladder-shaped conductors, whereby substantially U-shaped conductors are obtained.

As previously explained, even when the ladder-shaped conductors are employed, the substantially U-shaped conductors can be obtained by cutting the stacked core substrate. It should be noted that in the case of this ladder-shaped conductor, such a step for covering the opposite opening edge sides of the U-shaped conductors by the insulating layer is necessarily required.

(26) Also, the manufacturing method of the inductive element, according to the present invention, is featured by that in the case that said helical coils are formed, the bridge conductors are connected by skipping one of the bridge conductors with respect to the U-shaped conductor so as to form two pieces of the helical coils per a single chip.

As explained above, since two sets of the above-described helical coils are obtained, a common-mode choke coil and a transformer can be manufactured.

(27). Also, the manufacturing method of the inductive element, according to the present invention, in that the U-shaped conductors are coaxially formed on each of the core substrate in a multiple manner; and the multiple rectangular helical coils are formed by that in a cutting plane where the opening edges of the U-shaped conductors of the stacked core substrate, such U-shaped conductors having the same sizes and located adjacent to each other along the stacking layer direction are connected by said bridge conductors; and also, such U-shaped conductors provided at edge portions among the U-shaped conductors which are located adjacent to each other along inner/outer directions are connected by the bridge conductors.

As explained above, since the multiple helical coils are formed, such inductors having higher inductance values can be obtained.

Moreover, a chip-array component having plural chip elements can be produces if the cutting portions are suitably adjusted.

BRIEF DESCRIPTION OF THE DRAWINGS

FIG. 7C is a sectional view for representing a condition that holes have been pierced in an insulating layer formed on a portion of the electrode pad by using laser, or the like.

FIG. 12B is a side view for showing a condition under which an underlayer film has been formed on this core substrate by way of a sputtering, an electroless plating, or the like.

DETAILED DESCRIPTION OF THE EMBODIMENTS

First Embodiment

Figure 1A:
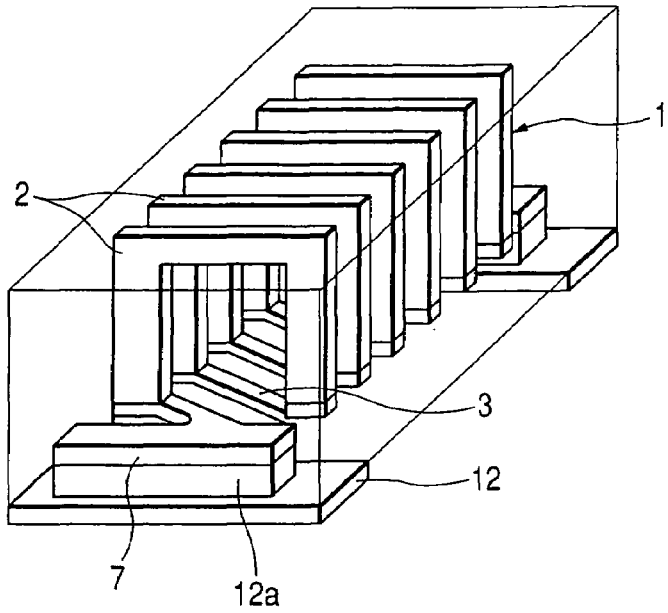
FIG. 1A is a transparent perspective view for showing an inductive element (helical coil) of an embodiment of the present invention.
Figure 1B:
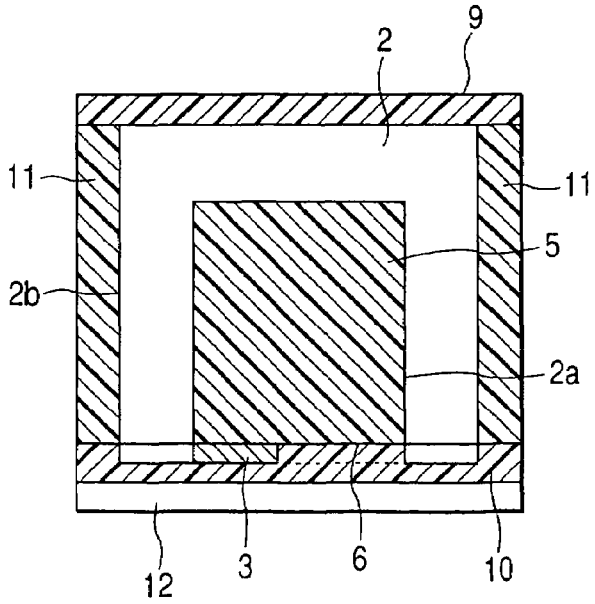
FIG. 1B is a sectional view for representing a structure of the helical coil.
Figure 1C:
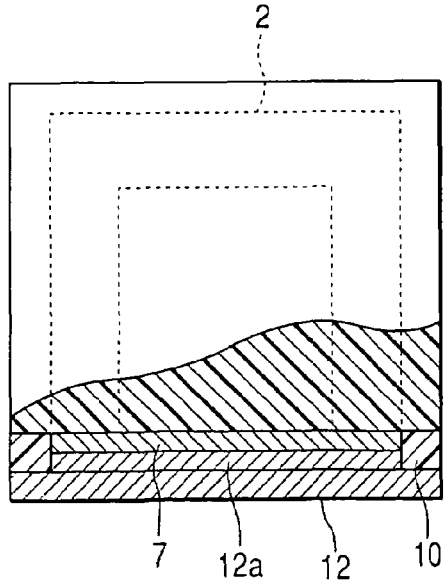
FIG. 1C is a sectional view for showing an electrode structure of the helical coil.
Figure 2A:
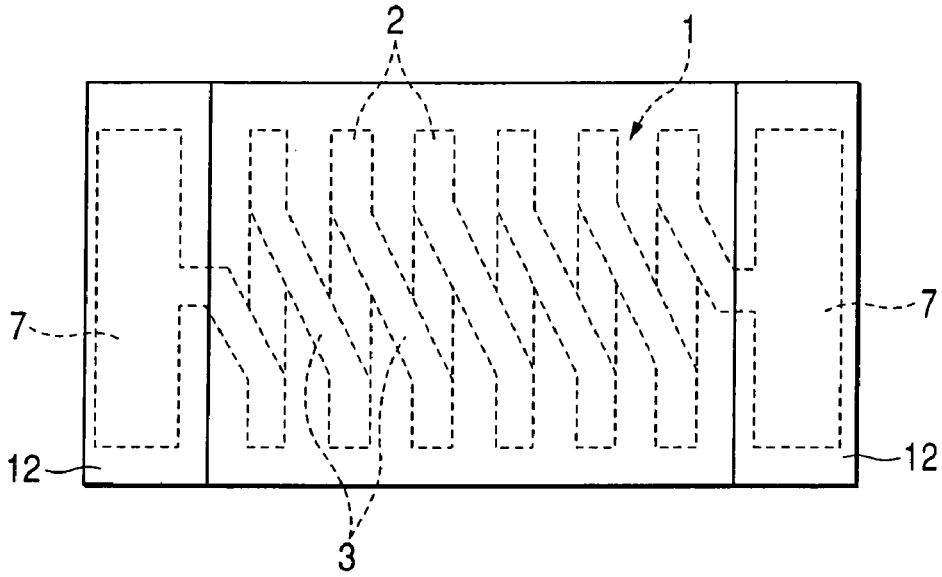
FIG. 2A is a bottom view for showing the inductive element according to this embodiment.

FIG. 1A is a transparent perspective view for showing an inductive element of a first embodiment of the present invention, FIG. 1B is a sectional view for representing a structure of the inductive element and FIG. 1C is a sectional view for showing an electrode structure of the inductive element. FIG. 2A is a bottom view for showing the inductive element according to this embodiment, and FIG. 2B is a sectional view for representing the inductive element.

Figure 2B:
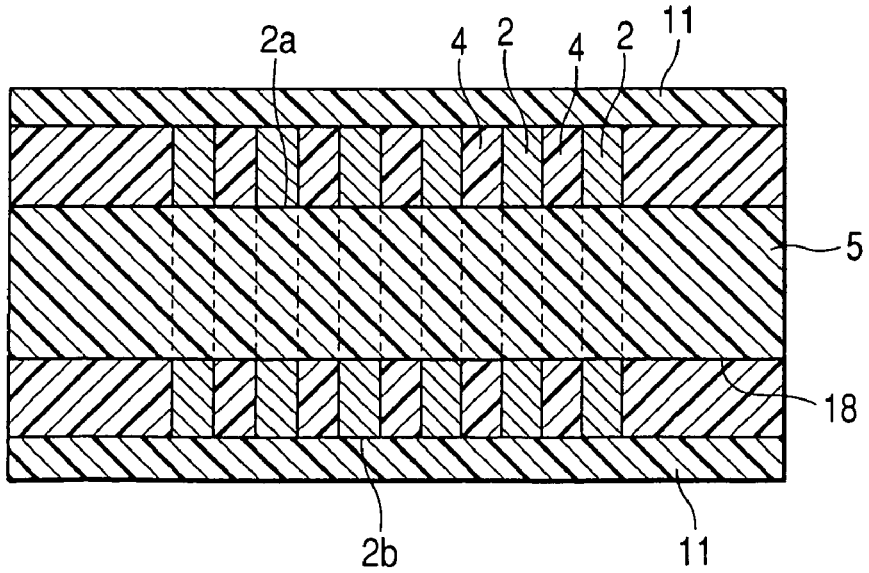
FIG. 2B is a sectional view for representing the inductive element.

In FIG. 1 and FIG. 2, reference numeral 1 shows a coil which is constructed in a rectangular helical shape. This helical-shaped coil 1 is arranged by a plurality of U-shaped conductors 2 which constitute 3 sides selected from 4 sides of this coil 1, and a bridge conductor 3. The bridge conductor 3 constitutes the remaining 1 side within the four sides, and connects two sets of U-shaped conductors 2 located adjacent to each other so as to constitute the rectangular helical-shaped coil 1 as an entire structure. As indicated in FIG. 2B, an insulating layer 4 is interposed between the U-shaped conductors 2 and 2. Both inner peripheral planes 2*a* and outer peripheral planes 2*b* of these U-shaped conductors 2 are mutually formed as the same planes as to a stacking direction thereof by a cutting step (will be explained later).

In other words, as shown in FIG. 2B, the inner peripheral planes are constituted as a side plane and a bottom plane of a groove 18 by executing a cutting step (will be discussed later) . An embedding material 5 is embedded into the groove 18. Both the embedding material 5 and a plane 6 (see FIG. 1B) on the side of openings of the U-shaped conductors 2 are matched by a polishing step, and then, both the bridge conductor 3 and electrode pads 7 on both ends are formed on this matched plane. Reference numerals 9 and 10 represent insulating layers formed in such a manner that these insulating layers 9 and 10 may cover an upper plane and a bottom plane of the inductive element. Reference numeral 11 shows insulating layers provided on both side planes. Reference numeral 12 represents terminal electrodes which are provided in the vicinity of both edges of the bottom plane of the inductive element, and reference numeral 12*a* shows a conductor which constitutes an underlayer used to connect the electrode pads 7 to the terminal electrodes 12.

To form the insulating layer 4, the embedding material 5, and the insulating layers 9 to 11 which cover the outer plane, either resin or a composite material is employed. In the composite material, functional material powder is mixed with resin. The U-shaped conductors 2 are made of either a metal plate or a metal foil. Also, as the insulating layer 4, a base material using a ceramics plate may be employed. Alternatively, such a base material that conducting paste which will constitute the U-shaped conductors 2 is coated on a ceramics green seat which will constitute the insulating layer 4, and then, the coated ceramics green seat is sintered. The bridge conductor 3 is made of a conductor which has been patterned by employing a photolithography method. This bridge conductor 3 may be formed in such a manner that a film is formed by not only a plating method, but also by a vapor deposition manner, or a sputtering method.

As the resin which constitutes the insulating layers 4, and 9 to 11, and also the embedding material 5, such thermosetting resin as—triazine (BT resin), epoxy, polyimide, and vinylebenzil may be employed. Alternatively, liquid crystal polymer and the like may be employed.

As dielectric materials which are mixed into the above-explained various resin in the powder form, such powder as melted silica, glass, qualtz, and alumina may be used. Also, since materials having low dielectric constants are employed as the above-explained resin and dielectric powder, the resultant materials may achieve better high frequency characteristics.

In addition, such composite materials made by mixing magnetic materials into resin may be employed. As these magnetic materials in this alternative case, powder of ferrite, an iron oxide, a metal iron, Permalloy, and SENDUST may be employed.

FIG. 7 to FIG. 3 are diagrams for indicating a method of manufacturing the inductive element shown in FIG. 1 and FIG. 2, according to the embodiment of the present invention. In this manufacturing method, first, either resin or a mixture made by mixing functional material powder with resin is dispersed to either a solvent or a binder so as to form a paste-like substance. Then, as shown in a perspective view of FIG. 3A, the above-explained paste-like substance is coated on a metal foil 2A used to obtain the U-shaped conductor 2 corresponding to a conductive layer by way of a doctor blade and the like, and the coated paste-like substance is dried to form an insulating layer 4A.

In this case, a copper foil is suitably employed as the above-explained metal foil 2A. Alternatively, nickel, silver, or an alloy made of nickel and silver may be employed. Also, a thickness of the metal foil 2A may be preferably selected to be 5 to 7.5 μm, and a thickness of the insulating layer 4A may be preferably selected to be 5 to 100 μm.

Figure 3A:
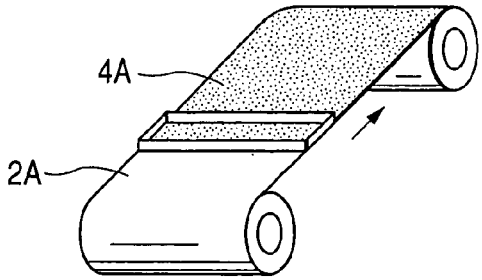
FIG. 3A is a perspective view for showing a seat which constitutes an original material, according to the embodiment.
Figure 3B:
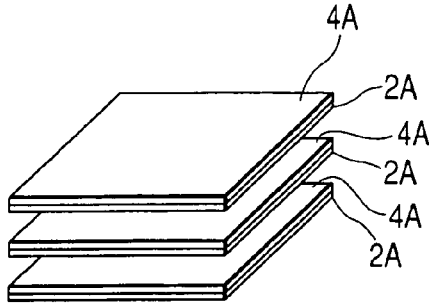
FIG. 3B is a perspective view for indicating cut seats which are obtained by cutting the seat every a predetermined length.

As indicated in a perspective view of FIG. 3B, the metal foil 2A on which this insulating layer 4A was cut in the dimension of a square of 10 cm.

Figure 3C:
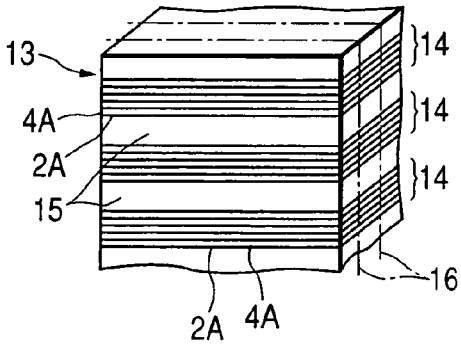
FIG. 3C is a partial perspective view for indicating a stacked layer base material which has been formed by stacking the cut seats in an integral manner.

Next, as represented in a partial perspective view of FIG. 3C, seats constructed of the metal foil 2A and the insulating layer 4A, which have been manufactured in the above-described manner, are stacked in an integral form by being thermally compressed, or via an adhesive layer, if necessary, so that a stacked base material 13 is obtained. In this embodiment, another insulating layer 15 having a thickness thicker than the thickness of the insulating layer 2A is interposed between sets 14 which will become equal to a thickness of a single inductive element, which are stacked in an integral form. It should be noted that this thicker thickness of the insulating layer 15 may be preferably selected to be 100 to 500 μm.

Figure 3E:
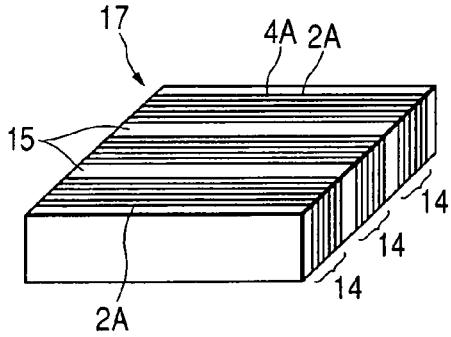
FIG. 3E is a partially-enlarged perspective view of the material shown in FIG. 3D.
Figure 3D:
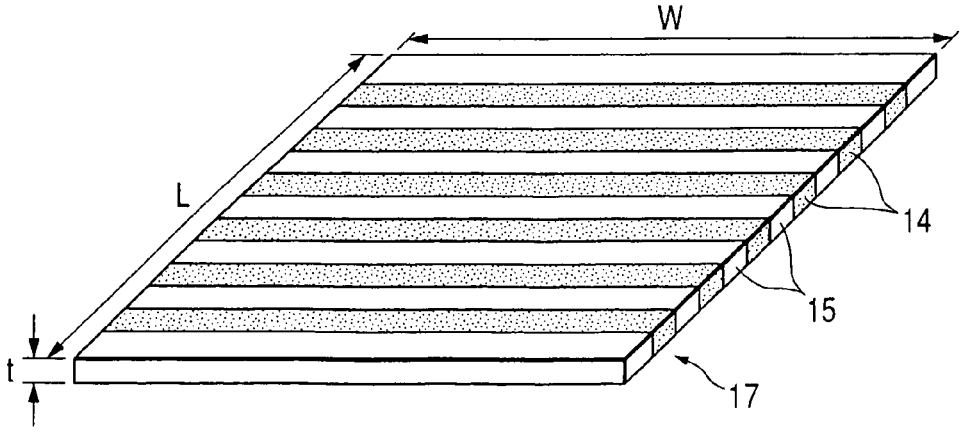
FIG. 3D is an entire perspective view for indicating a material obtained after the stacked base material has been cut/treated.

Next, as indicated by a two-dot/dash line 16 in FIG. 3C, the base material 13 is cut in an equi-interval along the stacking direction. As indicated in an entire perspective view of FIG. 3C, such a seat-shaped base material 17 having a thickness "t" was formed. This thickness "t" corresponds to a size of a U-shaped conductor 2 of a single inductive element (note that when inductive element is later polished, thickness of U-shaped conductor 2 of product becomes smaller than thickness "t" shown in this drawing) . Assuming now that the stacking direction of this base material 17 corresponds to a longitudinal direction, the base material 17 owns a total number of conductive layers equal to a total turn number of a plurality of inductive elements within a longitudinal width "L", and also, owns a size equal to a plurality of inductive elements within a lateral width "W." In the case of such an inductive element having the above-described size, for example, several tens of active elements are provided within the longitudinal width "L", and also within the lateral width "W." FIG. 3E is a partially-enlarged perspective view of FIG. 3D.

Figure 4A:
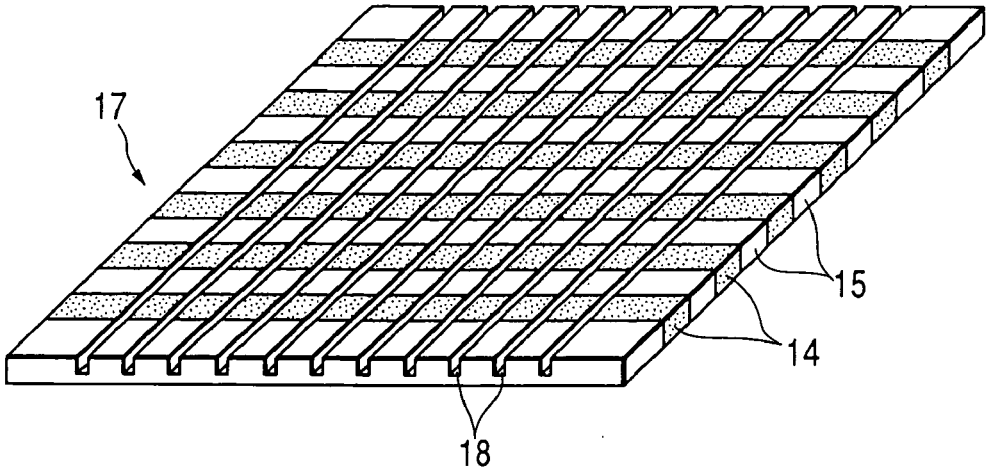
FIG. 4A is an entire perspective view for indicating a condition under which grooves have been formed in the material of this embodiment.
Figure 4B:
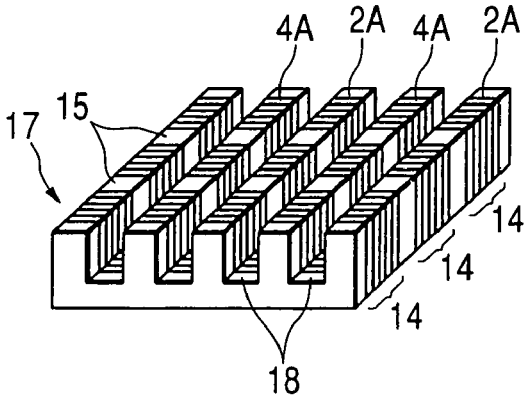
FIG. 4B is a partially-enlarged view for showing the condition of FIG. 4A.

Next, as represented in an entire perspective view of FIG. 4A and a partially-enlarged view of FIG. 4B, a groove 18 which will constitute an inner peripheral plane 2*a* of the U-shaped conductor 2 of the coil 1 was polished in an equi-interval along a direction intersected perpendicular to the stacking direction. It should be noted that both a width and a depth of this groove 18 are preferably selected to be 300 to 400 μm.

Figure 4C:
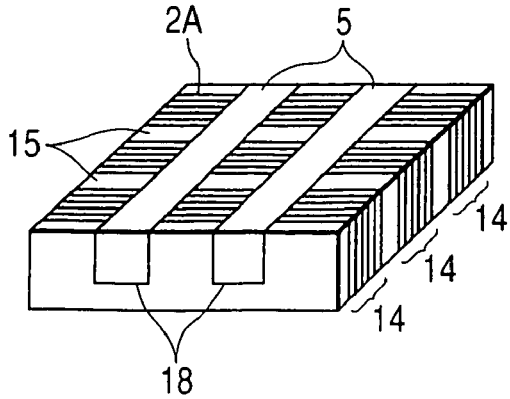
FIG. 4*c* is a partial perspective view for representing a condition under which embedding materials have been embedded in the groove portions.

Next, as indicated in a partially-enlarged perspective view of FIG. 4C, the above-explained embedding material 5 is embedded into the groove 18. As this embedding material 5, such a material is employed in which either the above-described resin or a composite material has been dispersed into either a solvent or a binder. The composite material is made by mixing functional material powder into resin. The embedding operation of this embedding material 5 is performed by coating the embedding material 5 on the forming plane of the groove 18 by way of a printing operation, and then, by drying the coated embedding material 5. Then, a surface (namely, will constitute bottom plane of product) of such a member that the embedding material 5 has been embedded into the groove 18 in the above-explained manner so as to remove a portion of the metal foil 2A which is covered by the embedding material 5. At the same time, this surface is matched (smoothed).

Figure 5A:
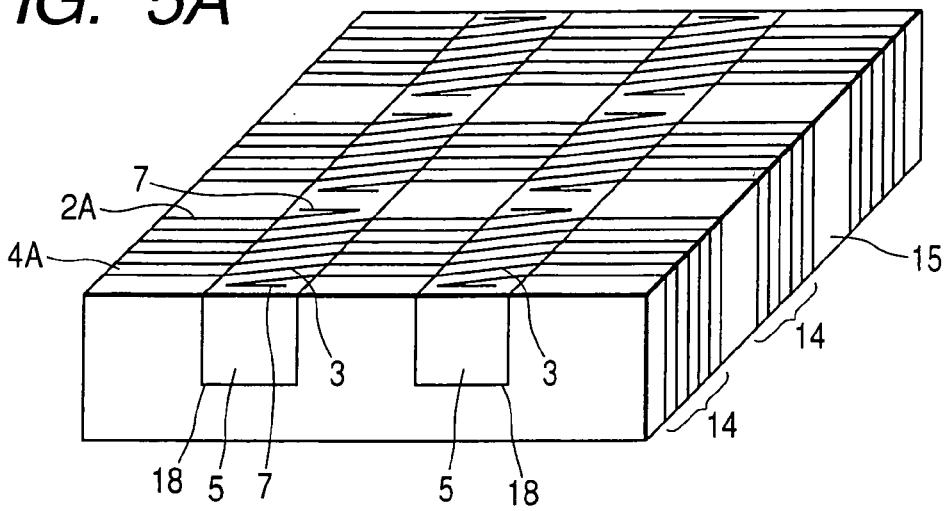
FIG. 5A is a partially-enlarged perspective view for showing such a condition that U-shaped conductors located adjacent to each other have been connected to each other by patterned conductors in the embodiment.
Figure 6A:
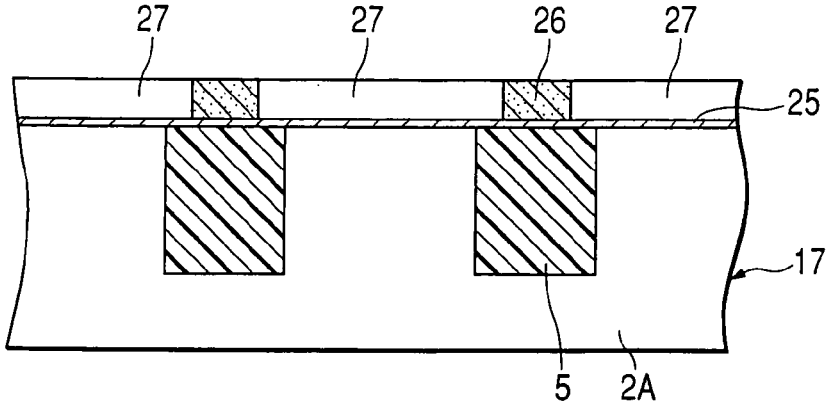
FIG. 6A is a sectional view for showing a condition under which both underlayer films and resist patterns have been formed so as to form bridge conductors over the base material in the embodiment.
Figure 6B:
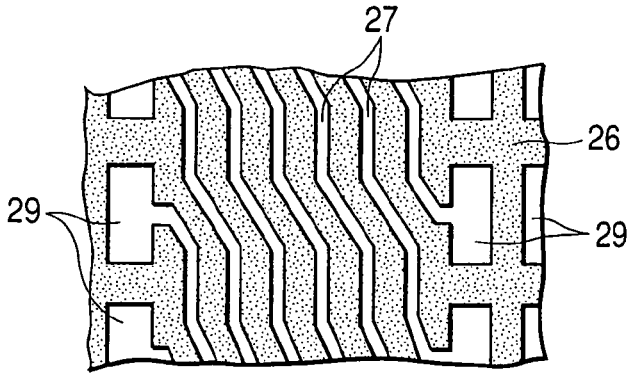
FIG. 6B is a plan view for indicating this condition of FIG. 6A.
Figure 6C:
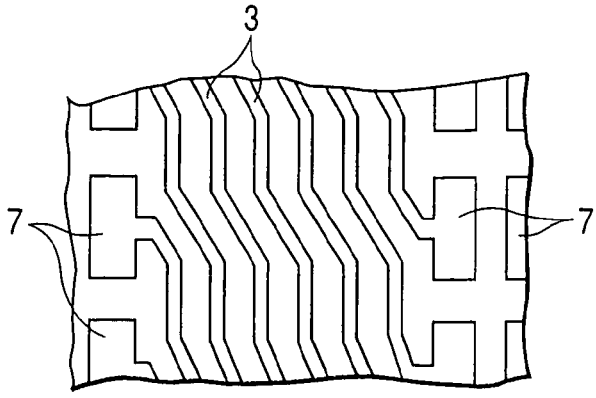
FIG. 6C is a plan view for indicating both the bridge conductors and the patterns of an electrode pads, which have been formed by removing a plating portion and a resist.

Next, as shown in a partially-enlarged perspective view of FIG. 5A, both a bridge conductor 3 and an electrode pad 7 are formed on the plane which has been matched (smoothed) as explained above by employing a photolithography method, while this bridge conductor 3 is used in order to connect the adjoining U-shaped conductor 2 to each other. This patterning operation is carried out as follows. That is, as indicated in, for example, FIG. 6A and FIG. 6B, a copper film is formed as an underlayer 25 on an entire surface of the base material 17 by executing either an electroless plating operation or a sputtering operation. Subsequently, a resist 26 is coated on the entire surface, and then, both a resist of a portion 27 which should become the bridge conductor 3, and another resist of another portion 29 which should become the electrode pad 7 are removed by using the photolithography method. A major plating layer made of copper is formed on these resist removing portions 27 and 29 by performing an electro plating operation. Thereafter, both the resist 26 and the underlayer 25 located under this resist 26 are removed.

Figure 5B:
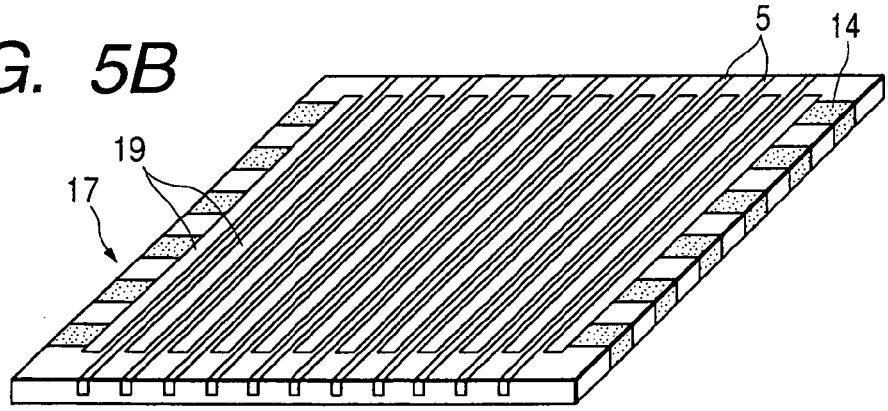
FIG. 5B is an entire perspective view for representing a condition under which slits have been formed in portions among the U-shaped conductors.
Figure 5C:
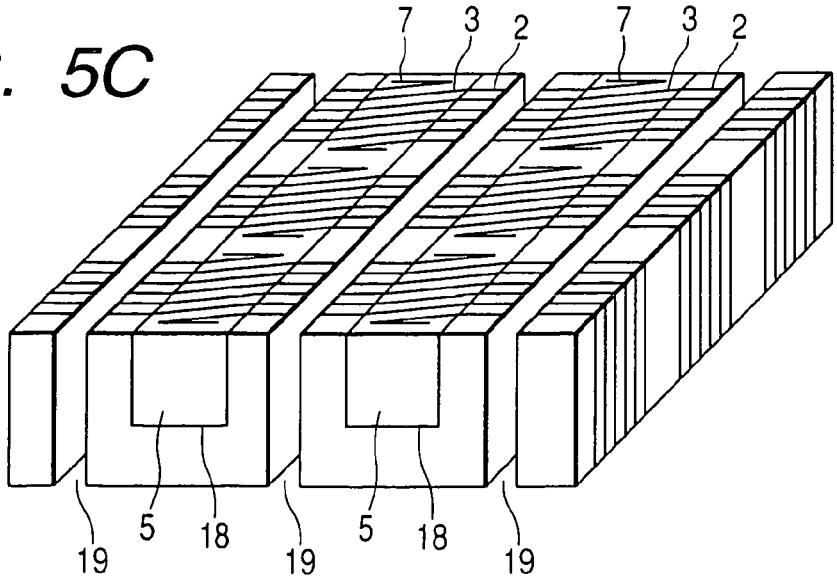
FIG. 5C is a partially-enlarged perspective view for showing the condition of FIG. 5B.
Figure 7A:
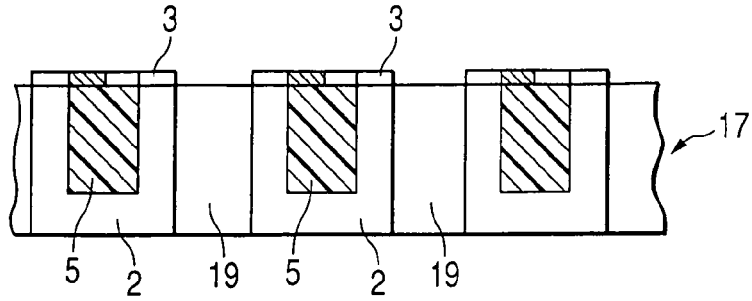
FIG. 7A is a sectional view for indicating the material of FIG. 5C.

Next, as shown in an overall perspective view of FIG. 5B, a partially-enlarged perspective view of FIG. 5C, and a sectional view of FIG. 7A, slits 19 are formed in portions between the grooves 18 into which the embedding materials 5 have been embedded, while both edge portions of the base material 17 are lefted. The slits 19 penetrate through the front face and the rear face of this material 17.

Figure 7B:
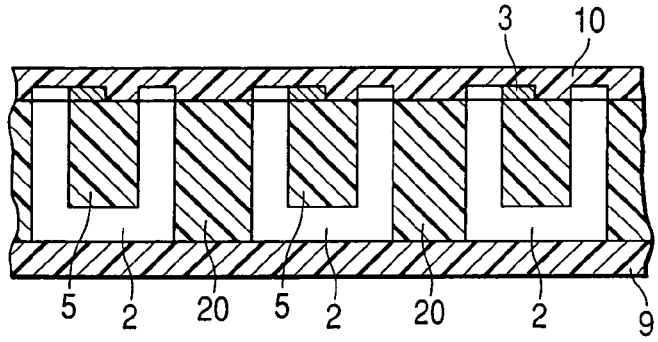
FIG. 7B is a sectional view for showing a condition under which an insulating material has been applied to slits of this material and front/rear surfaces of this material.

Next, as shown in FIG. 7B, insulating materials 20 made of either the above-explained resin or the above-described composite material are filled into the portions where the slits 19 are formed by way a printing operation. Next, as shown in FIG. 7B, such insulating materials made of either the resin or the composite material are coated on both the front face and the rear face of the base material 17 so as to form insulating layers 9 and 10. In such a case that the same materials are employed so as to form these insulating layers 9 and 10, and the insulating material 20, since these insulating layers 9/10 and insulating material 20 are formed at the same time, a total manufacturing step may be reduced.

Figure 7C:
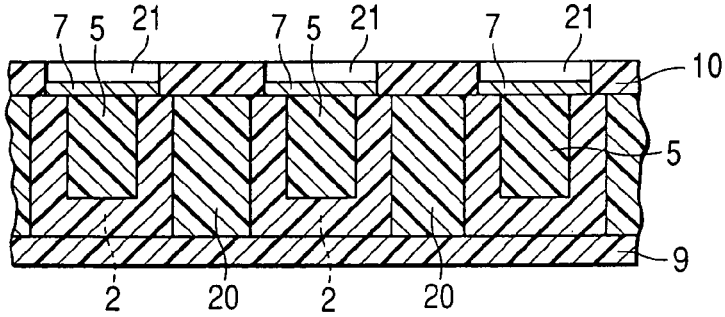
Figure 7D:
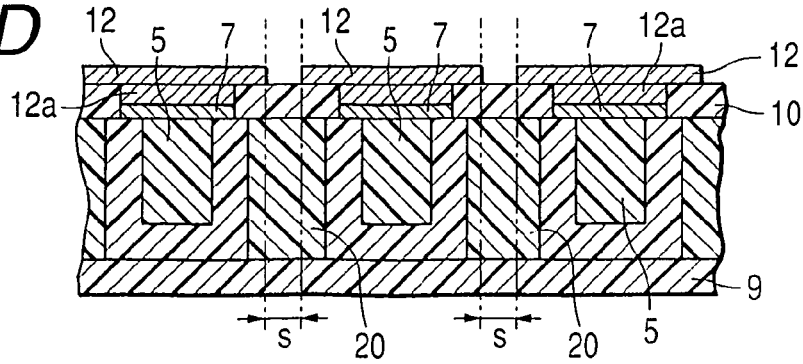
FIG. 7D is a sectional view for indicating a condition under which terminal electrodes have been formed on the holes and surfaces thereof.

Next, as shown in FIG. 7C, holes 21 are pierced in the insulating layer 10 located above the portion of the above-described electrode pad 7 by using laser, or the like. Then, an electric conductive agent is filled into the holes 21 by way of the electro plating treatment and the printing manner. The electric conductive agent is made of copper functioning as an underlayer 12*a*, or made by mixing silver into resin functioning as the underlayer 12*a*. Next, for example, nickel and tin are plated on this filled electric conductive agent in this order, so that terminal electrodes 12 for soldering operation are formed.

Figure 8:
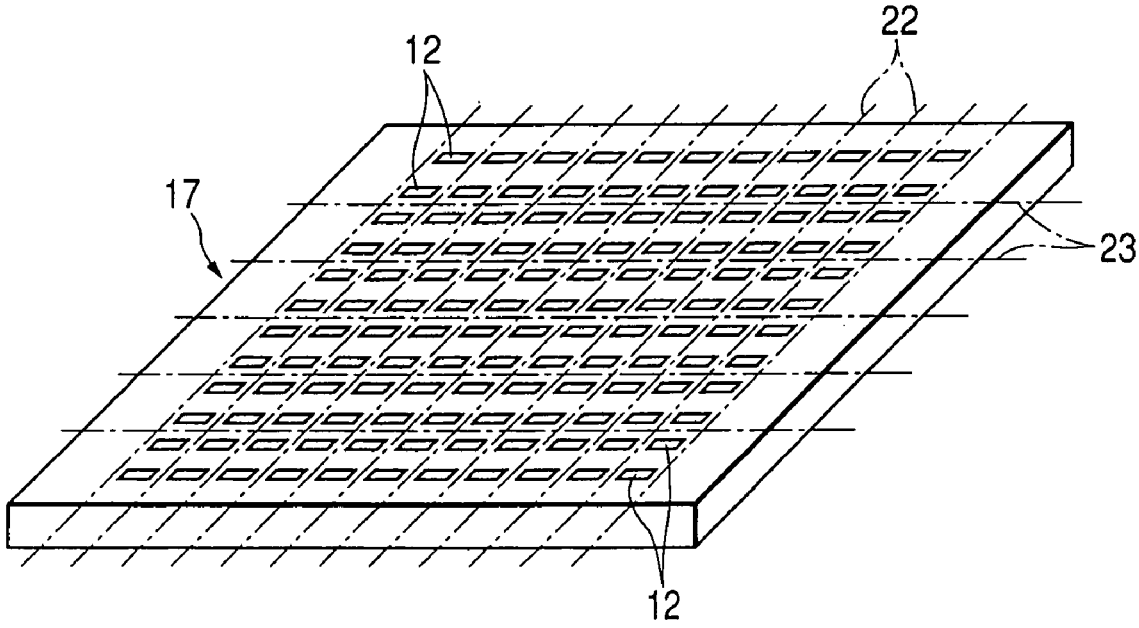
FIG. 8 is an entire perspective view for showing both the base material and cutting portions, in which two sets of terminal electrodes have been formed on helical coils formed in this base material in correspondence with each of these helical coils.

FIG. 8 is an entire perspective view for showing the base material 17 in which the helical coils 1 have been formed and two sets of the terminal electrodes 12 have been formed in correspondence with each of these helical coils 1. As shown in FIG. 8, this base material 17 is cut by employing a dicing machine along lines 22 in a direction located perpendicular to the direction of the grooves 18. After this cutting treatment, or before this cutting treatment, as indicated by a width "s" in FIG. 7D and as shown by the lines 22 in FIG. 8, the base material 17 is cut by employing the dicing machine in such a manner that center portions of the insulating materials 20 filled in the slits 19 may be removed, so that the above-described insulating layers 11 of the side planes are formed, and further the respective chips of inductive elements are obtained.

As previously explained, in accordance with the inductive element of the embodiment of the present invention, since the U-shaped conductors 2 of the helical coils 1 and the outer peripheral portions are formed by way of the cutting treatment, such inductive elements having the narrow tolerance can be manufactured. That is, the coil shapes of these helical coils 1 can be matched with each other, the positional fluctuations between the U-shaped conductors can be reduced, the fluctuations of the stacked layers can be decreased, and the inductance values thereof can be made equal to each other.

Also, since the conductor processing operation is carried out in which the base material 17 is cut to obtain the helical coils 1 within one time, the manufacturing operation of the inductive elements can be carried out in an easy manner, and thus, the inductive elements can be made at a lower cost. Also, as explained in this embodiment, the embedding material 5 and the insulating layers 9 to 11 are constituted by either the resin or the composite material thereof, these insulating layers 9 to 11 can be easily processed.

Although such a sintered member made of the electric conductive adhesive agent and the ceramics of the above-described conductor paste may be employed as the conductor, as explained in connection with this embodiment, if the metal foil 2A is employed, then the resistivities of the U-shaped conductors can be suppressed to lower values. As a result, the DC resistance values can be lowered and the high Q characteristics can be obtained.

Also, since the planes used to form the conductors 3 are matched by way of the polishing treatment, the edge portions of the U-shaped conductors 2 can be connected to the conductors 3 under better conditions, and the coil shapes can be further matched with each other. The conductors 3 correspond to the bridge portions which have been formed by way of the patterning operation.

As explained in this embodiment, while the slits 19 are formed in the cutting regions among the grooves 18, where the chips are arrayed in the column form, the insulating materials 20 are filled into these slits 19. Then, if the center portions of these filled insulating materials 20 are cut by employing the cutting means, then the chips in which both side planes of the respective chips have been covered by the insulating materials can be formed at the same time when the center portions are cut. Thus, such a post-staged process operation for applying the insulating materials to the side surfaces of the chips is no longer required, and the chips can be manufactured in a higher efficiency.

In the case that the base material 17 is obtained, as explained in this embodiment, since the materials equivalent to a plurality of chip thicknesses are obtained at the same time to be cut, a total forming step number of the stacked member can be decreased.

In the present invention, such a condition that the thickness "t" of the base material 17 is equivalent to one piece of the inductive element 1 implies such a thickness by which one piece of such an inductive element may be obtained. Alternatively, while the thickness "t" (see FIG. 3) of the U-shaped conductor 2 is set to be larger than a thickness of a product, this thickness "t" may be polished so as to obtain a desirable thickness.

Also, the present invention may be applied to any sizes smaller than the above-described size and/or any sizes larger than the above-explained size, and a metal plate may be alternatively employed instead of the metal foil 2A.

A description is made of a concrete example. That is, an inductive element was experimentally manufactured under such a condition that a total turn number was 12, a longitudinal width×a lateral width of a plane were defined by 1 mm×0.5 mm, and also, a thickness thereof was 0.5 mm. In this experimental inductive element, such a composite material made by dispersing/mixing silica powder into vinylbenzil resin was employed as the embedding material 5 and the insulating layers 4, 9 to 11. The relative dielectric constant "ϵ" of this composite material is 2.9. Also, while a metal foil made of copper was employed as the coil conductor 2, the thickness of this copper foil was selected to be 35 μm; the thickness of the insulating layer 4 was selected to be 25 μm; the width of the groove 18 was selected to be 360 μm; and the depth of this groove 18 was selected to be 330 μm. Also, thin film copper was employed as the bridge conductor 3. The inductance value of this experimental inductive element was 15 nH, and the Q-factor thereof was approximately 60 (1 GHz) . On the other hand, when the conventional coil having the spiral structure made of the thin film and having the same size as that of the experimental inductive element is manufactured, the Q-factor is approximately 20. Also, when the conventional coil is manufactured by the ceramics stacked layer member, the Q-factor is approximately 30. As a result, it is possible to confirm that the Q-factor of the inductive element according to the present invention could be largely improved.

Figure 9A:
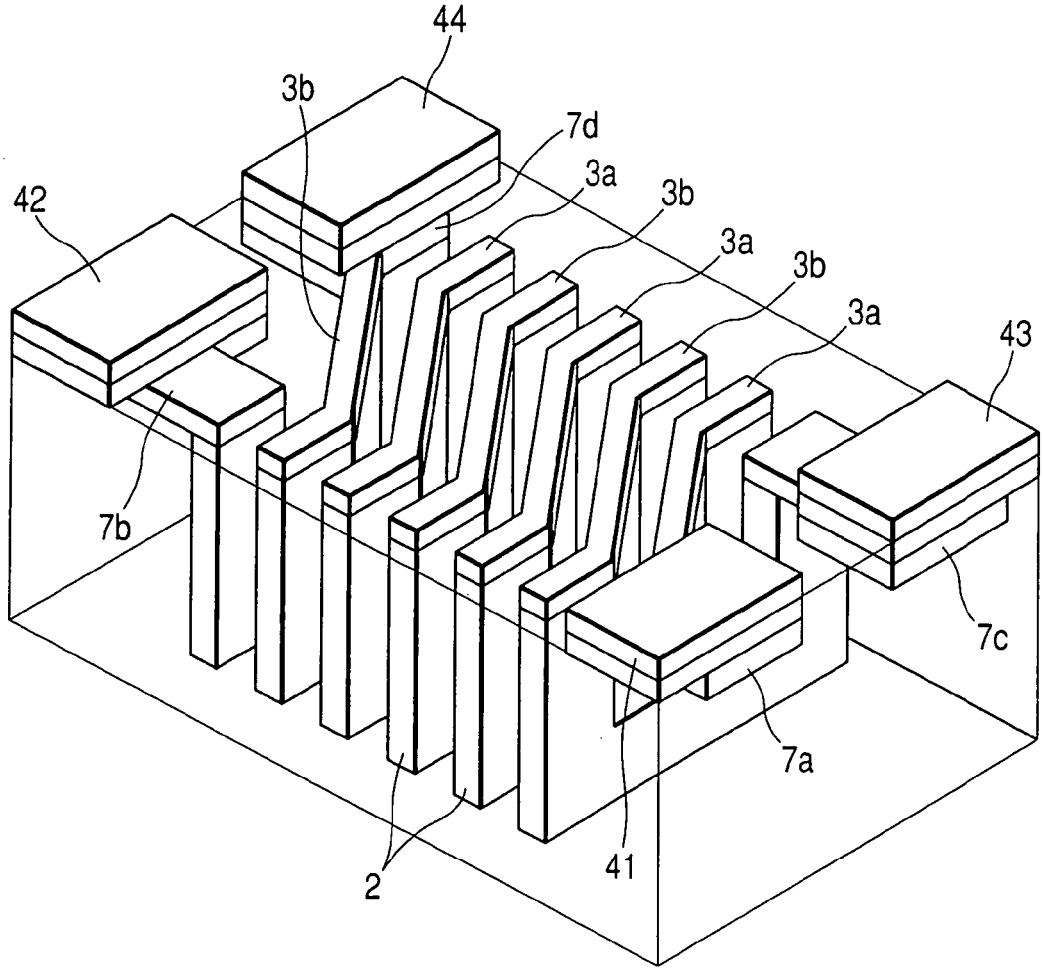
FIG. 9A is a transparent perspective view for indicating an inductive element according to another embodiment of the present invention.

FIG. 9A shows an inductive element according to another embodiment of the present invention. This inductive element has been constituted as a choke coil, or a transformer. In this embodiment, two sets of rectangular helical coils are formed in such a manner that a series of coils are manufactured by mutually connecting the U-shaped conductors 2 to each other by the conductors 3*a* and 3*b*, while skipping one U-shaped conductor. In this drawing, reference numerals "7*a*" and "7*b*" indicate electrode pads which are connected to both ends of one helical coil within two helical coils; reference numerals "7*a*" and "7*b*" represent electrode pads which are connected to both ends of the other helical coil within these two helical coils; and reference numerals 41 to 44 show terminal electrodes formed on these electrode pads 7*a* to 7*d*.

As previously explained, since the connection structure by the bridge conductor between the U-shaped conductors 2 and 2 is changed, two sets of the helical coils may be formed.

Figure 9B:
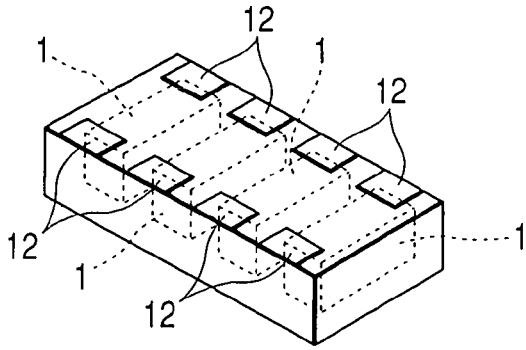
FIG. 9B is a perspective view for representing an inductive element according to another embodiment of the present invention.

Also, as shown in FIG. 9B, such an inductive element array may be alternatively arranged in which a plurality of helical coils are built in a single chip and are arranged in parallel to each other.

In the inductive element of the present invention, while the magnetic material is employed in at least one of the insulating layers (namely, side-surface insulating layer 9, insulating layer 10 of bottom plane, and insulating layer 11 of upper plane) which cover the embedding material 5 and the outer peripheral portions of the coils, since the dielectric substance is employed in the U-shaped conductor 2, the inductive element having the higher inductance value can be formed. In this case, the composite material made by mixing the magnetic powder into the resin may be employed as the embedding material 5. Alternatively, since a rod-shaped metal magnetic member covered with an insulating material is employed which is known as the above-explained Permalloy and SENDUST and owns a high magnetic permeability, such an inductive element having a higher inductance value may be obtained. Further, since such a magnetic member which constitutes a magnetic core is embedded into the groove 18 and such a magnetic material made by mixing magnetic powder into resin is employed also in the insulating layers 9 to 11 provided on the outer peripheral portions of the helical coils, an inductive element having a higher inductance value may be alternatively obtained. It should also be noted that when this metal magnetic material is employed, this metal magnetic material is preferably and electrically insulated from the U-shaped conductor 2 within the grooves 18 by employing an insulating adhesive material so as to be fixed thereto.

The inductive element according to the present invention maybe utilized as a single electric component such as an inductor element and a transformer. In addition, for example, this inductive element may be arranged by being combined with other electronic components such as a capacitor and a resistor in an integral form. Otherwise, this inductive element may be alternatively assembled into a module.

In accordance with the present invention, both the inner peripheral plane and the outer peripheral plane of the U-shaped conductor of the helical coil are formed by cutting the base material, and the other edge is constituted by the patterned conductor. As a result, the helical coil can be easily mass-produced, the shift of the conductor patterns is small, and the inductance value of the narrow tolerance can be obtained. Also, since either the metal plate or the metal foil is employed as the conductor, such an inductive element capable of achieving the high Q characteristic can be manufactured.

<Second Embodiment>

Figure 10A:
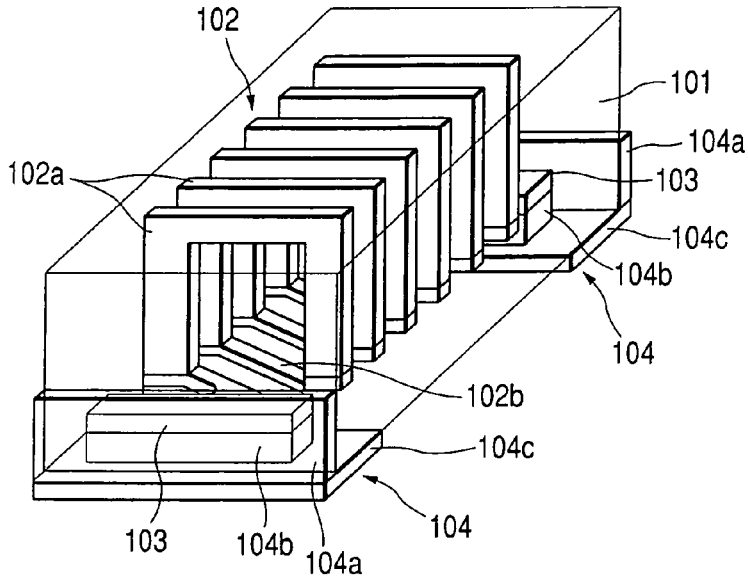
FIG. 10A is a transparent perspective view for showing an inductive element according to another embodiment of the present invention.
Figure 10B:
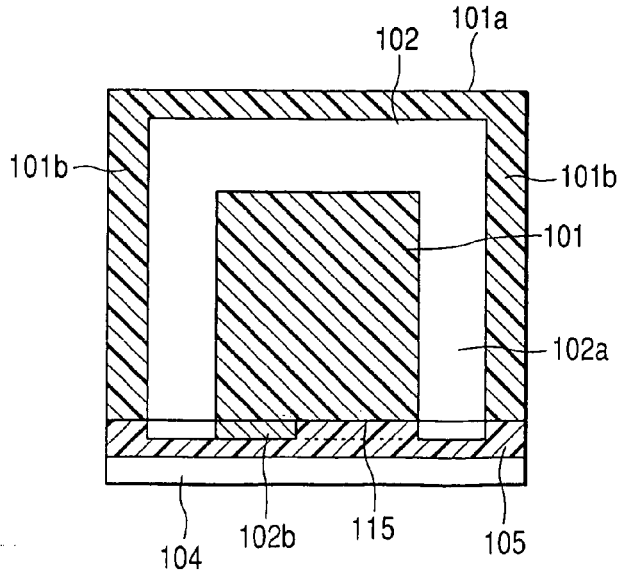
FIG. 10B is a sectional view for indicating a structure of the inductive element shown in FIG. 10B.
Figure 10C:
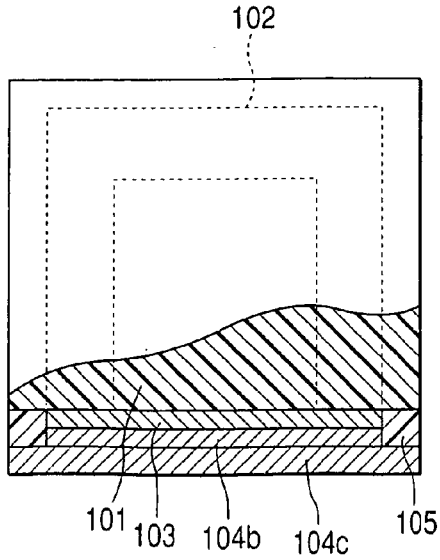
FIG. 10C is a sectional view for representing an electrode structure of this coil.
Figure 11:
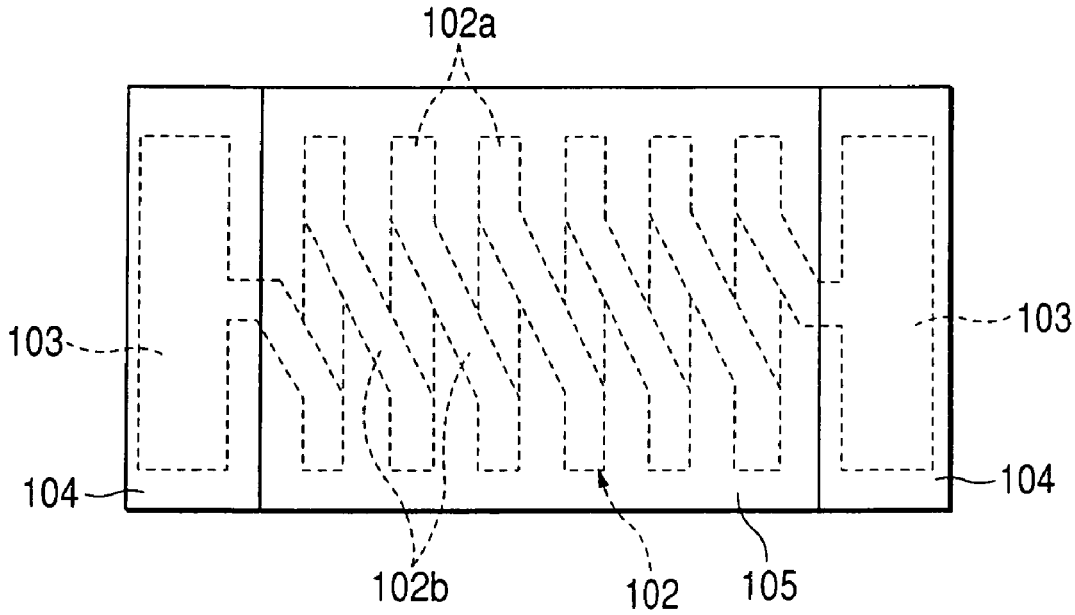
FIG. 11 is a bottom view for showing the inductive element indicated in FIG. 10.

FIG. 10A is a transparent perspective view for showing an inductive element (helical coil) of an embodiment of the present invention; FIG. 10B is a sectional view for representing a structure of the helical coil of FIG. 10A; and FIG. 10C is a partially sectional view for showing an terminal electrode structure of the helical coil. FIG. 11 is a bottom view for showing the inductive element according to this embodiment.

In FIG. 10, reference numeral 101 shows an insulating member, reference numeral 102 indicates a coil arranged in a rectangular helical shape, reference numeral 103 represents an electrode pad, and reference numeral 104 denotes a terminal electrode. The terminal electrode 104 has an edge plane portion 104*a* formed on an edge plane thereof. Reference numeral 105 shows an insulating layer which is provided on a mounting plane with respect to a printed board (not shown).

The helical coil 102 is arranged by a U-shaped conductors 102*a* are arranged in such a manner that opening edges thereof are directed to the same direction, and these U-shaped conductors 102*a* own an interval and are aligned along longitudinal/lateral directions. The bridge conductors 102*b* are employed so as to connect opening edges of the U-shaped conductors 102*a* and 102*a* in a bridge form, and are formed by employing the photolithography method.

As a base material of the insulating member 101, a core substrate is employed which is made of either a ceramics substrate or a composite material which is made by resin, or by mixing functional material powder into resin. As to resin used in the case that the insulating member 101 is constituted by the resin, or the composite material, and also, as to resin which constitutes the insulating layer 105, such thermosetting resin as—triazine (BT resin), epoxy, polyimide, and vinylebenzil may be employed. Alternatively, liquid crystal polymer and the like may be employed.

As dielectric materials which are mixed into the above-explained various resin in the powder form, such powder as melted silica, glass, qualtz, and alumina may be used. Also, since materials having low dielectric constants are employed as the above-explained resin and dielectric powder, the resultant materials may achieve better high frequency characteristics.

In addition, such composite materials made by mixing magnetic materials into resin may be employed. As these magnetic materials in this alternative case, powder of ferrite, an iron oxide, a metal iron, Permalloy, and SENDUST may be employed.

FIG. 12 to FIG. 15 are diagrams for indicating a method of manufacturing the inductive element shown in FIG. 10 and FIG. 11, according to the embodiment of the present invention. In FIG. 12, reference numeral 101A indicates a core substrate. This core substrate 101A is made of a ceramics substrate such as an alumina substrate, or a composite-material-made substrate which is formed by mixing functional material powder into a resin substrate, or resin.

Figure 12A:
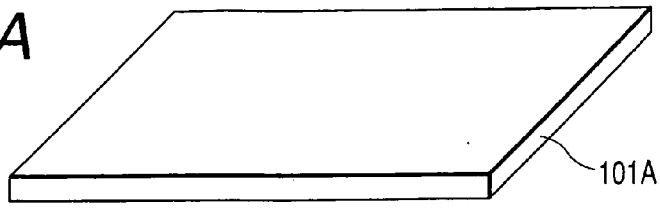
FIG. 12A is a perspective view for showing a core substrate which constitutes a base material, according to this embodiment.
Figure 12B:
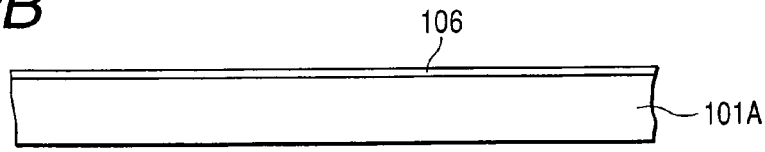
Figure 12C:
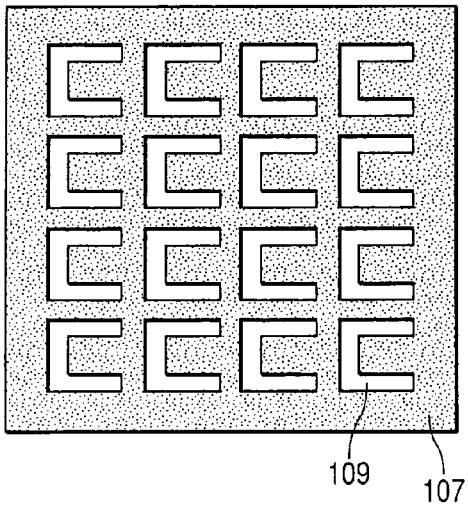
FIG. 12C is a plan view for indicating a condition under which a resist pattern has been formed on the core substrate.
Figure 12D:
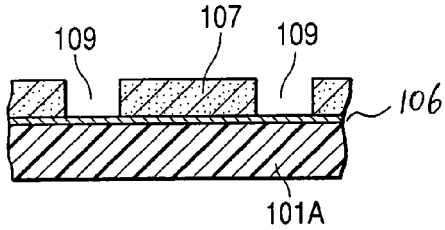
FIG. 12D is an enlarged sectional view for indicating the condition of FIG. 12C; and both

In this embodiment, U-shaped conductors 102*a* are formed on a surface of the core substrate 101A by employing a photolithography method in such a manner that a plurality of the U-shaped conductors 102*a* are arranged along the longitudinal/lateral directions. First, with respect to the core substrate 101A shown in FIG. 12A, an underlayer film 6 made of copper is formed over an entire portion of the core substrate 101A by way of an electroless plating treatment as indicated in FIG. 12B. Next, as represented in FIG. 12C and FIG. 12D, a resist 107 is coated, or attached to the surface of the core substrate 101A. Then, a plurality of U-shaped resist removing portions 109 used to for a band-shaped conductor are formed by performing an exposing process operation and a resist removing process operation (namely, photolithography method). In an actual case, more than several tens of these resist removing portions 109 are formed, and lengths of these resist removing portions 109 are made equal to lengths of several tens of chips. For the sake of easy explanations, smaller sets and smaller lengths of these resist removing portions 109 are illustrated in the drawing.

Figure 12E:
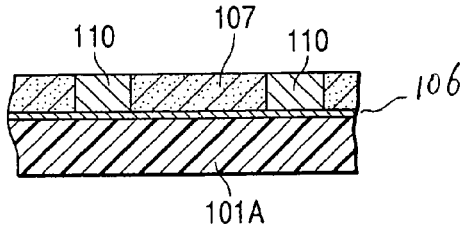
FIG. 12E and FIG. 12F are sectional views for showing a condition under which a U-shaped conductor has been formed by way of an electroless plating, and another condition that both a resist and the underlayer film have been subsequently removed.
Figure 12F:
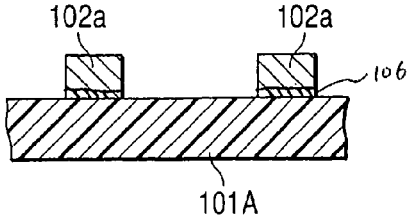
Figure 13A:
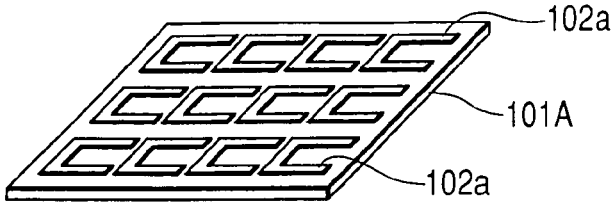
FIG. 13A is a perspective view for representing a core substrate on which the U-shaped conductor according to the embodiment has been formed.

Next, as shown in FIG. 12E, a major plating layer 110 made of copper is formed on the portions of the above-explained resist removing portions 109 by way of an electro plating treatment. Thereafter, as shown in FIG. 12F, both the resist 107 and the underlayer film 106 made of copper are removed so as to form the above-explained U-shaped conductors 102*a* by the remaining portion. FIG. 13A indicate a core substrate 101A on which the U-shaped conductors 102A have been formed.

Figure 13B:
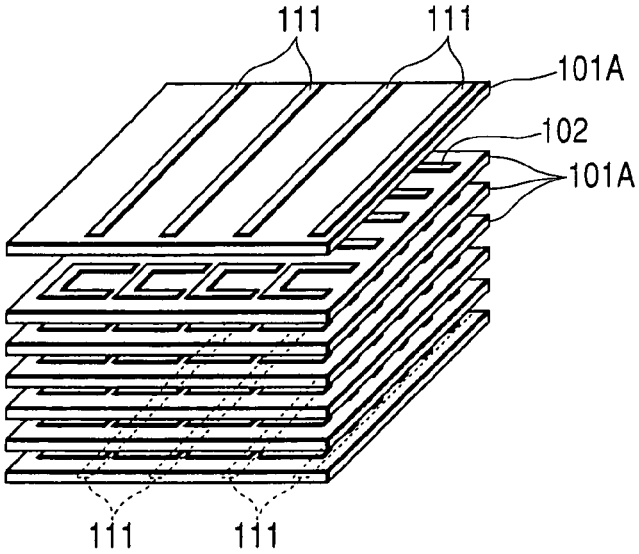
FIG. 13B is an exploded perspective view for showing a stacked construction of this core substrate.

As shown in FIG. 13B, plural sheets of the above-explained core substrates 101A which have been manufactured in the above-explained manner are overlapped with each other so as to constitute a stacked core substrate 101B. Also, the core substrates 101A are overlapped with each other which are formed at the portions corresponding to the U-shaped conductors 102*a*, and further, such a core substrate on which conductor layers 111 have been formed is overlapped on another core substrate 101A (namely, lowermost portion of this drawing) provided on the opposite side. Then, these plural sheets of core substrates 101A are formed in an integral form under such a condition that these core substrates 101A are overlapped with each other.

In such a case that the core substrates 101A are made of either thermosetting resin or a composite material of this thermosetting resin, the core substrates 1A may be formed in an integral form in such a manner that prepregs under semi-hardening condition are directly stacked, and then the stacked prepregs are processed by applying pressure and heat so as to be completely hardened. Alternatively, the core substrates 101A may be formed in an integral form in such a way that the U-shaped conductors 102*a* are formed on substrates under hardening condition, and prepregs under semi-hardening condition are sandwiched between these substrates, and then, the resulting substrates are processed by applying pressure and heat so as to be completely hardened. Further, in the case that the core substrates 101A are made of either thermoplastic resin or a composite material of this thermoplastic resin, these core substrates 101A are formed in an integral form by applying heat and melting these materials. In the case that the core substrates 101A are made of ceramics substrates, these ceramics substrates are formed in an integral form by way of an adhesive process operation.

Figure 13C:
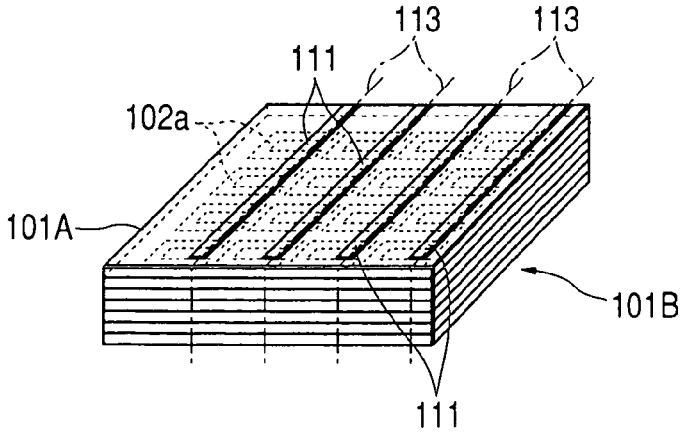
FIG. 13C is a perspective view for representing a stacking condition of the core substrate.
Figure 13D:
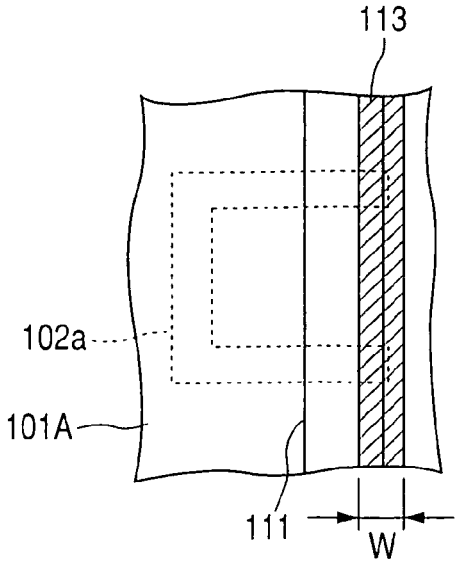
FIG. 13D is a plan view for representing a cutting portion of the core substrate.
Figure 14A:
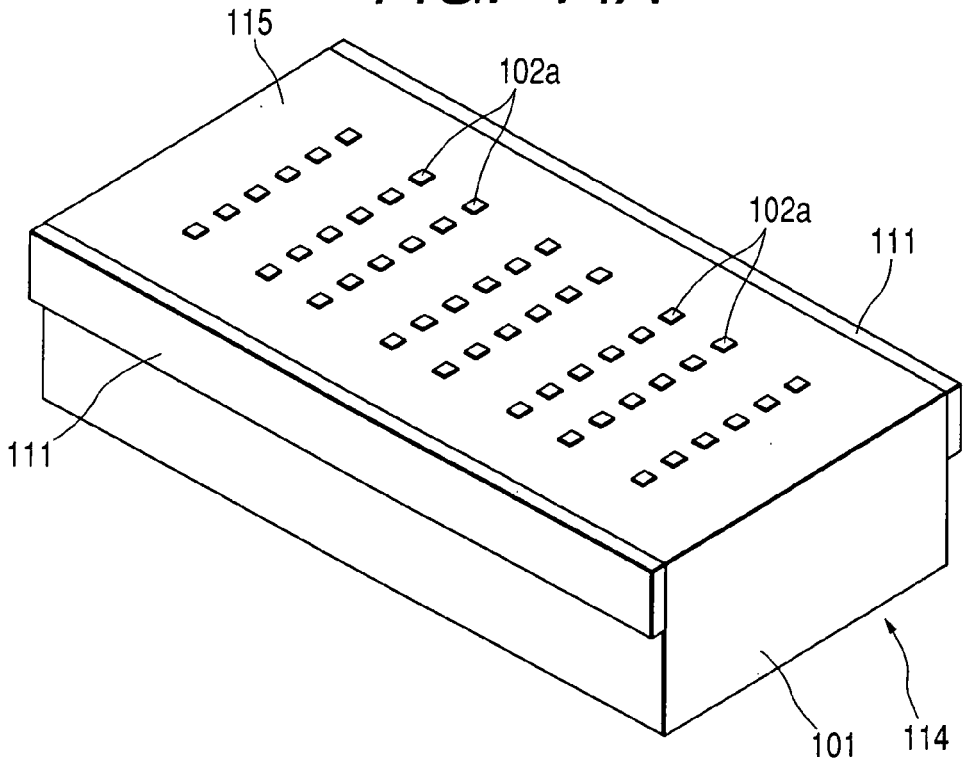
FIG. 14A is a perspective view for indicating a stick-shaped base material obtained by cutting the core substrate in the embodiment.

Thereafter, as shown in FIG. 13C, the integrally-formed core substrates 100A are cut along cutting lines 113, so that a stick-shaped base material 114 shown in FIG. 14A is obtained. As represented in FIG. 13D, both a position of this cutting line 113 and a cutting width "W" thereof are set in such a manner that an opening edge of one U-shaped conductor 102*a* is exposed from a cutting plane 115, and a portion of the conductor layer 111 which constitutes the above-described terminal electrode is cut. When a portion of this conductor layer 111 is cut, at the same time, insulating layers 101*a* and 101*b* (see FIG. 10B) are formed on the outer face portions of the U-shaped conductors 102*a* respectively.

Figure 14B:
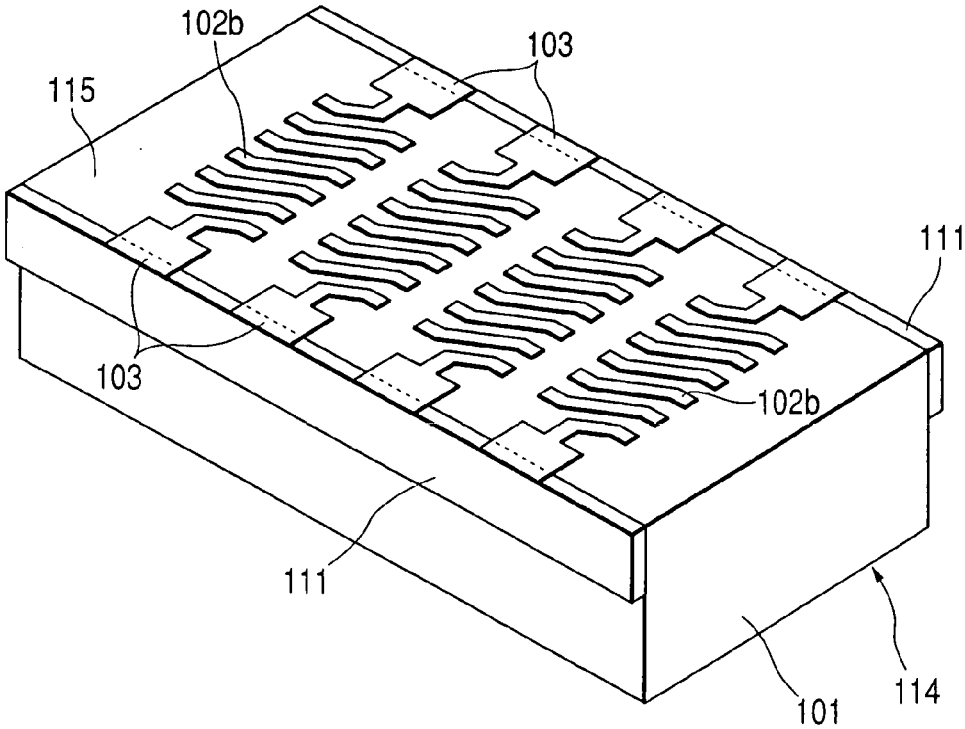
FIG. 14B is a perspective view for representing a condition under which both a bridge conductor and an electrode have been formed on a cutting sectional plane of this stick-shaped base material.

Next, as shown in FIG. 14B, the bridge conductors 102*b* are formed on the cutting plane 115, and such opening edges adjacent to each other among the opening edges of the U-shaped conductors 102*a* are connected to each other, so that helical coils are formed and, at the same time, the above-explained electrode pads 103 are formed.

FIG. 15 is a diagram for schematically showing manufacturing steps after the above-explained bridge conductors 102*b* are formed. As shown in FIG. 15A, an insulating layer 105 is formed on the cutting plane 115 where the bridge conductors 102*b* have been formed, while this insulating layer 105 covers both the bridge conductors 102*b* and the electrode pads 3.

The forming operation of this insulating layer 105 is carried out in such a manner that either a resin seat or a seat made of the above-described composite material is thermally compressed, or adhered. Alternatively, insulating paste made of these resin seat and composite material is coated.

Figure 15A:
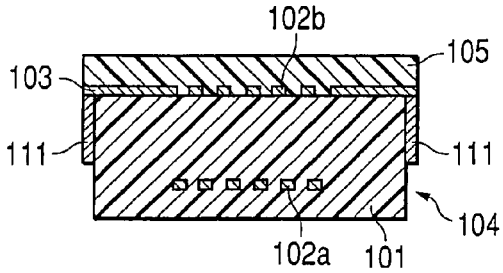
FIG. 15A is a sectional view for indicating a condition under which an insulating layer has been formed on the cutting sectional plane in the embodiment.
Figure 15B:
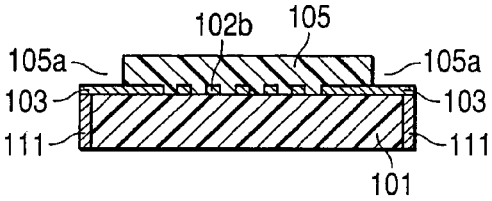
FIG. 15B to FIG. 15E are sectional views for indicating one example of electrode forming steps.

FIG. 15B to FIG. 15G schematically represent forming steps of the terminal electrodes 104. As indicated in FIG. 15B, the insulating layers 105*a* formed on the electrode pads 103 are removed by using laser, or the like. It should be noted that when the coating operation of the insulating layers 105*a* is carried out by way of either a screen printing operation or a photolithography method, the above-described portion which is removed by the laser, or the like may be previously formed as a region in which the insulating layers 105*a* are not provided.

Figure 15C:
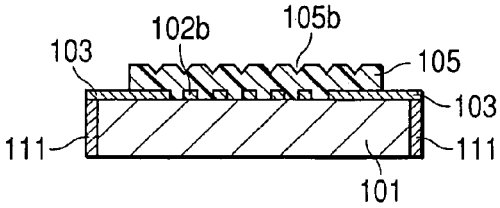
Figure 15D:
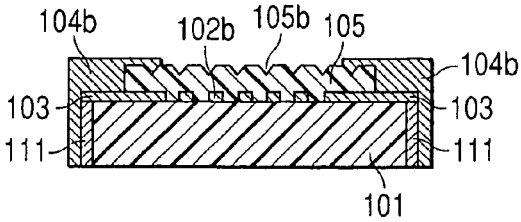
Figure 15E:
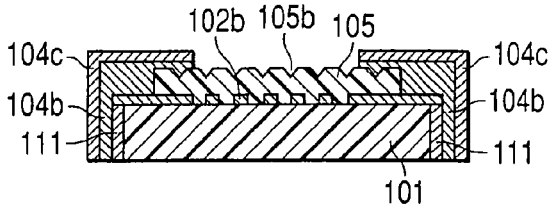

Next, as shown in FIG. 15C, a surface 105*b* of the insulating layer 105 is solved by either sand blasting or a solvent so as to become a coarse surface by which an adhesive strength by a plating operation is increased. Then, as shown in FIG. 15D, an underlayer 104*b* which constitutes a terminal electrode 104. is formed by way of either a plating operation or electric conductive paste. Thereafter, as indicated in FIG. 15E, a metal layer 104*c* made of nickel, tin, and the like is formed by way of an electro plating operation, while the metal layer 104*c* is used so as to solder this inductive element to the substrate.

Figure 15F:
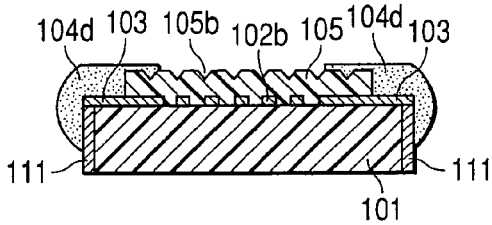
FIG. 15F and FIG. 15G are sectional views for indicating another example of electrode forming steps.
Figure 15G:
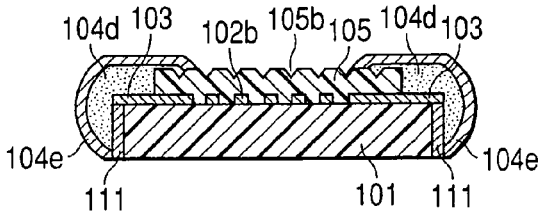

FIG. 15F and FIG. 15G schematically show another example as to a method of forming the terminal electrode 104. In this forming method, conductor paste 4*d* is filled into the removed portion of the insulating layer 105 byway of a printing operation, on which a metal layer 104*e* is formed by way of an electro plating operation. The metal layer 104*e* is made of nickel, tin, and the like, and is employed so as to execute a soldering operation.

Figure 15H:
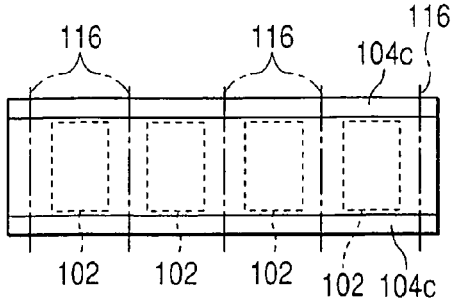
FIG. 15H is a bottom view for indicating cutting portions with respect to respective chips.

Thereafter, this base material 114 is cut at the portions corresponding to the cutting lines 116 of FIG. 15H, so that respective inductive element chips may be obtained.

In this embodiment, in order to form the U-shaped conductors 102*a* on the core substrates 101A, the semi-additive manufacturing method has been employed as the photolithography method. Alternatively, the band-shaped conductors 113 may be formed by employing an additive manufacturing method, or a pattern etching treatment (subtract method) of a conductive film such as a metal foil. Also, either a sputtering method or a vapor depositing method may be alternatively employed so as to form the metal film. Also, a similar manufacturing method may be employed when the bridge conductors 102*b* are formed.

In this inductive element, since the U-shaped conductors 102*a* are formed within one time on the same planes of the core substrates 101A, the positional precision of the coil patterns can be increased. Also, the inductive elements can be effectively manufactured in an easy manner and at a lower cost, as compared with such a case that the through holes are formed. Also, since the U-shaped conductors 102*a* are formed on the same plane of the core substrates 101A within one time, there is no limitation as to the conductor lengths and the conductor sectional areas as in such a case that the through holes are formed. Further, the conductors, the sectional areas of which are not fluctuated, can be formed, so that the inductive elements can be manufactured in the easy manner, and at the lower cost. Also, since the coils are formed in the helical shapes, the Q characteristics of the coils can be increased.

Also, there is a free degree in the manufacturing methods in view of the construction. A composite material made of either an organic material or an inorganic material, and another composite material made of both an organic material and an inorganic material may be used as the use material. The electric high-performance characteristics optimized in response to use fields may be realized.

Also, if such a base body having a low dielectric constant is constituted as the insulating member 101 and the insulating layer 105 by employing those made of the composite material obtained by mixing the functional material powder in the resin, then such a base body having a high self-resonance frequency may be obtained, and the processing operation thereof may be easily carried out. Also, since the functional material powder is selected, various inductive elements having various characteristics maybe obtained which are adapted to industrial purposes.

Further, since the U-shaped conductors 102*a* are formed byway of the photolithography method and the bridge conductors 102*b* are formed by way of the photolithography method, it is possible to provide such inductive elements having lower resistivities and higher Q-factors.

FIG. 16 schematically shows a manufacturing method of an inductive element according to another embodiment of the present invention, namely indicates such an example that a plurality of the above-explained stacked core substrates 101B are overlapped with each other via adhesive layers 117 so as to be constituted by a single set of collected base material 119. It should be noted that in order to cut the adhesive layer 117 later, a thickness of this adhesive layer 117 is made thicker than a thickness of another core substrate 101A. Then, first of all, as indicated by cutting lines 20 of FIG. 16A, the collected base material 17 is cut, so that a plate-shaped base material 122 is obtained in which forming regions 21 of the U-shaped conductors 102*a* which constitute the inductive elements are formed along longitudinal/lateral directions as represented in a plan view of FIG. 16B.

Since the bridge conductors 102*b* may be manufactured by the photolithography method, the insulating layers 105 may be formed, and the terminal electrodes 104 may be formed in the combination manner, such a plate-shaped base material 22 can be manufactured in a higher efficiency, and the manufacturing cost can be reduced. After the bridge conductors 102*b*, the insulating layers 105, and the terminal electrodes 104 have been manufactured, the plate-shaped base material 117 is cut along the cutting lines 23 and 24 in the longitudinal/lateral directions so as to manufacture the respective inductive element chips.

Figure 16A:
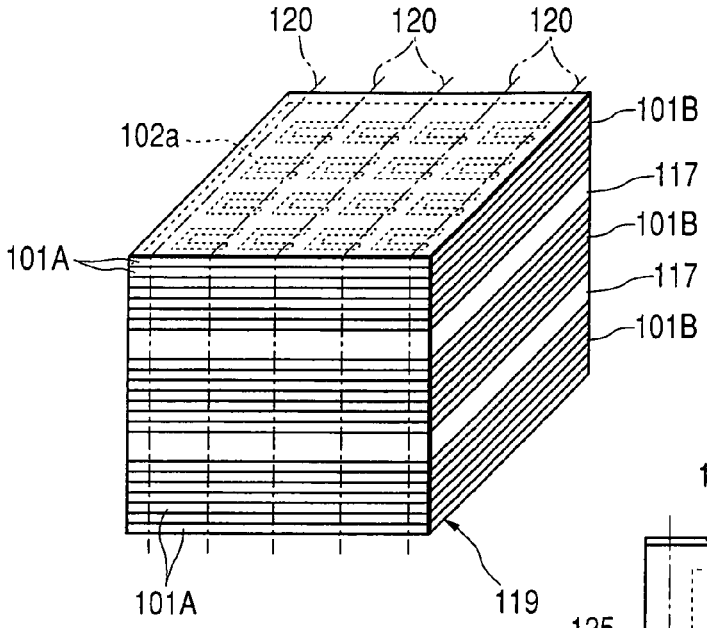
FIG. 16A is a perspective view for showing a stacked core substrate manufactured by a manufacturing method of an inductive element according to another embodiment of the present invention.
Figure 16C:
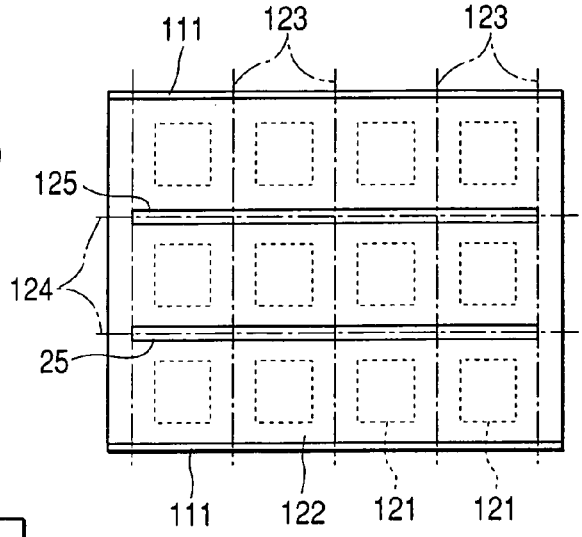
FIG. 16C is a plan view for showing another base material formed by a manufacturing method of an inductive element according to another embodiment of the present invention.
Figure 16B:
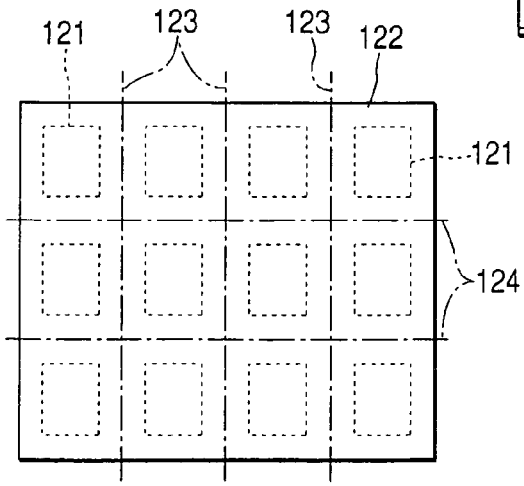
FIG. 16B is a plan view for indicating a cutting position of the stacked core substrate of FIG. 16A.
Figure 16D:
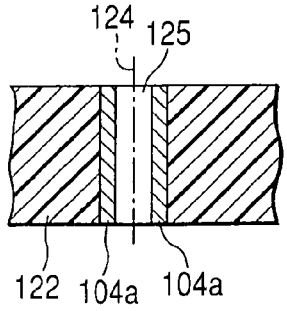
FIG. 16D is a sectional view for representing a slit structure which is formed in a boundary portion between the inductive element of FIG. 16C.

FIG. 16C and FIG. 16D schematically show a manufacturing method of an inductive element according to another embodiment of the present invention, namely corresponds to another example of the above-explained plate-shaped base material. This embodiment is to manufacture such an inductive element that a terminal electrode 104 owns an edge plane portion 104*a* in accordance with the following method. That is, while conductor layers 114 which constitute the edge plane portion 104*a* of the above-described terminal electrode 104 are formed on both edge planes of the collected base material 119 shown in FIG. 16A, the resulting collected base materials 119 are stacked, and furthermore, slits 125 are formed in the portions of the adhesive layers 117 which become boundaries among the inductive elements. As indicated in FIG. 16D, an underlayer film 104*a* of the edge plane portion of the terminal electrode 104 is formed in this slit portion by way of both an electroless plating operation and an electro plating operation. Thereafter, the resulting collected base material 119 is cut along a cutting line 124.

In accordance with this embodiment, similar to the above-described embodiment, the bridge conductors 102*b* may be manufactured by the photolithography method, the insulating layers 105 may be formed, and the terminal electrodes 104 may be formed in the combination manner. It is possible to provide such an inductive element which can be strongly fixed to a predetermined stable position of a printed board.

FIG. 17 is a schematic diagram for indicating a manufacturing method of an inductive element according to another embodiment of the present invention. In this embodiment, as shown in FIG. 17A, the inductive elements are manufactured in such a manner that double U-shaped conductors are arrayed along longitudinal/lateral directions on the surface of the above-described core substrate 101A. Each of the double U-shaped conductors is constituted by an inner peripheral U-shaped conductor 102*c* and an outer peripheral U-shaped conductor 102*d*. Similar to the above-explained case, as indicated in FIG. 17B, a stacked core substrate obtained by stacking such core substrates is cut in order that opening edges of the inner peripheral U-shaped conductor 102*c* and of the outer peripheral U-shaped conductor 102*d*. Alternatively, after this stacked core substrate has been cut, these opening edges of the U-shaped conductor 102*c* and 102*d* are exposed by polishing the opening edges. Then, as shown in FIG. 17B, the opening edges of the inner peripheral U-shaped conductor 102*c* are connected to each other by bridge conductors 102*e* by way of a photolithography method so as to form inner peripheral-sided helical coils, and also to form one-sided electrode pads 103*a*.

Figure 17A:
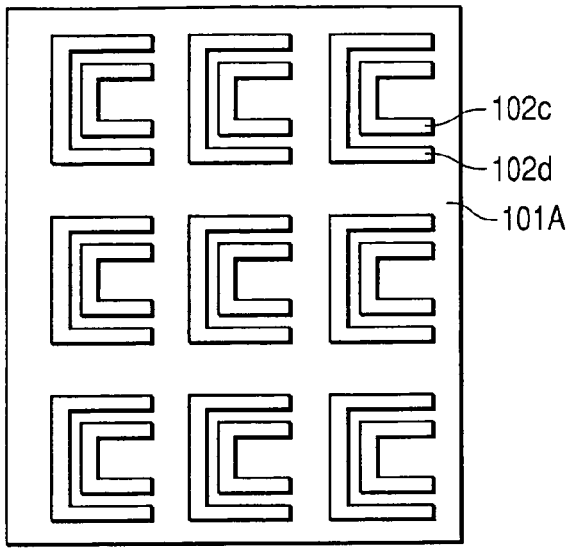
FIG. 17A is a plan view for indicating a core substrate formed by a manufacturing method of an inductive element according to another embodiment of the present invention.
Figure 17B:
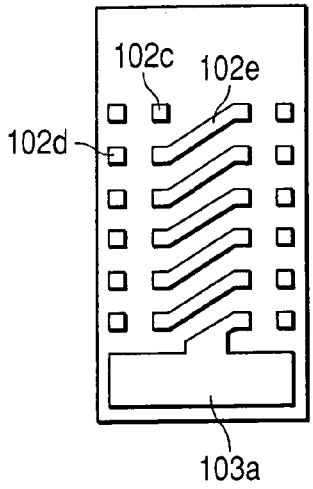
FIG. 17B to FIG. 17E are plan views for representing steps for forming a bridge conductor to this core substrate.
Figure 17C:
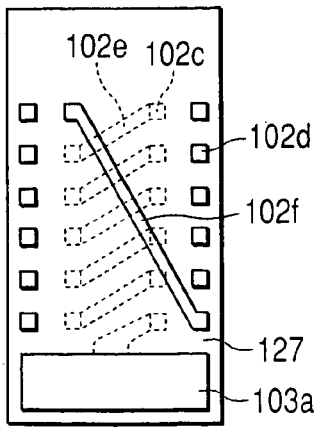

Next, as shown in FIG. 17C, while one exposed portions of one edge portions among the inner peripheral U-shaped conductor 102*c* are left, which are not connected by the bridge conductors 102*e* along the stacking layer direction, all of the exposed portions of the outer peripheral U-shaped conductors 102*d* are left, and the electrode pads 103*a* are left, these inner peripheral U-shaped conductors 102*c* are covered by an insulating layer 127 in combination with the bridge conductors 102*e*. Then, among the inner peripheral U-shaped conductors 102*c*, the opening edges of the U-shaped conductors of the exposed edge portions are connected to one opening edges located at opposite sides among the outer peripheral U-shaped conductors 102*d* by employing bridge conductors 102*f*.

Figure 17D:
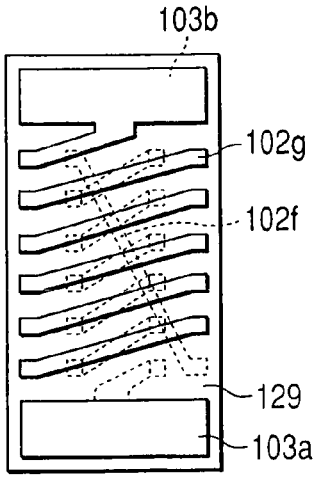
Figure 17E:
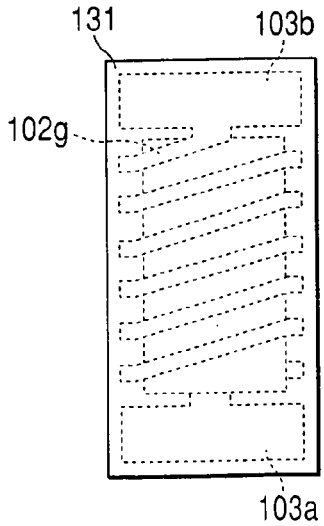

Next, as shown in FIG. 17D, while such exposed portions except for the exposed portions connected via the bridge conductors 102*f* among the exposed portions of the outer peripheral U-shaped conductors 102*d* are lefted and the electrode pads 103*a* are lefted, these exposed portions are covered by another insulating layer 129. Then, bridge conductors 102*g* is formed which are used to connect the outer peripheral U-shaped conductors 102*d* located adjacent to each other. At the same time, the other electrode pad 103*b* is formed. Thereafter, an entire mounting plane is covered by an insulating layer 131. Subsequently, as explained above, an electrode is formed and the base material is cut.

As previously explained, if the double, or multiple helical coils are constructed in a coaxial manner, then a total turn number of these helical coils can be increased, so that inductive elements having higher inductance values can be manufactured. It should also be noted that in this embodiment, the U-shaped conductors of the opposite-sided edge portions along the stacking layer direction among the U-shaped conductors located adjacent to each other along the inner/outer directions are connected to each other in order that the magnetic fluxes generated from the inner/outer coils are directed to the same direction. Alternatively, depending upon the method for connecting the bridge conductors located adjacent to each other along the stacking direction, such U-shaped conductors provided on the same side edge portions along the stacking layer direction may be connected to each other in order that the magnetic fluxes generated from the inner/outer coils are directed to the same direction.

Figure 18A:
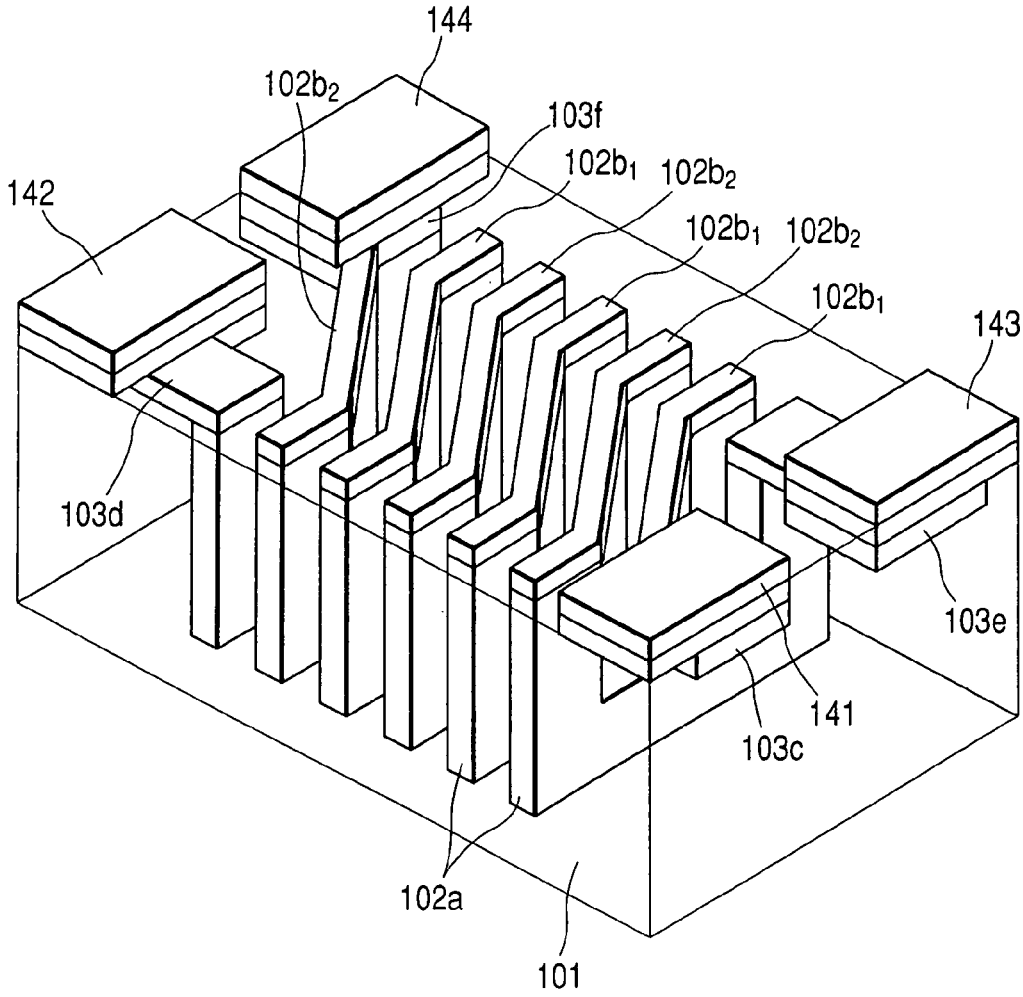
FIG. 18A and FIG. 18B are perspective views for indicating an inductive element according to another embodiment of the present invention.

FIG. 18A shows an inductive element according to another embodiment of the present invention. This inductive element has been constituted as a common-mode choke coil, or a transformer. In this embodiment, two sets of rectangular helical coils are formed in such a manner that a bridge conductor divides a U-shaped conductor 102*a* into two conductors 102*b*1 and 102*b*2 with respect to the U-shaped conductor 102*a*. In this drawing, reference numerals "103*c*" and "103*d*" indicate electrode pads which are connected to both ends of one helical coil within two helical coils; reference numerals "103*c*" and "103*f*" represent electrode pads which are connected to both ends of the other helical coil within these two helical coils; and reference numerals 141 to 144 show terminal electrodes formed on these electrode pads 103*c* to 103*f*.

As previously explained, since the connection structure by the bridge conductor between the U-shaped conductors 102*a* and 102*a* is changed, two sets of the helical coils maybe formed.

Figure 18B:
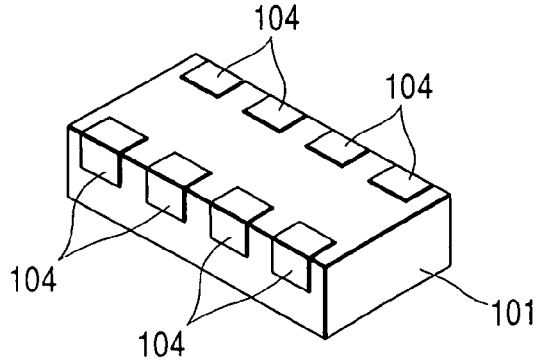

Also, as shown in FIG. 18B, such an inductive element array may be alternatively arranged in which a plurality of helical coils are built in a single chip and are arranged in parallel to each other.

Figure 19:
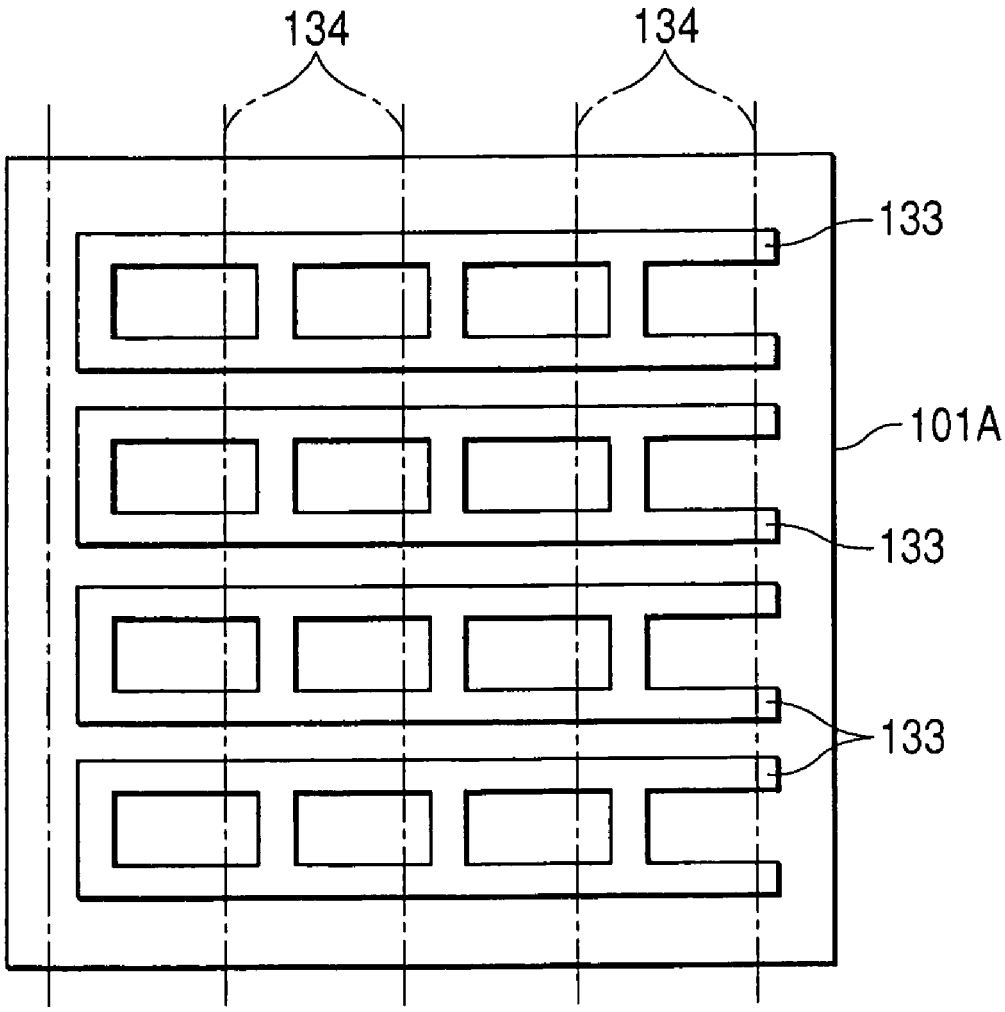
FIG. 19 is a plan view for showing a core substrate formed by a manufacturing method of an inductive element according to another embodiment of the present invention.

FIG. 19 is a plan view for indicating a core substrate formed by a manufacturing method of an inductive element according to another embodiment of the present invention. In this embodiment, conductors 133 which are formed on a core substrate 101A are formed in such a shape that ladders are arranged in parallel to each other. In this example, as indicated by cutting lines 134, such portions in the vicinity of steps of these ladders are cut. As a result, conductors having substantially U-shaped may be formed. In this embodiment, an insulating layer is required to be formed on a plane located opposite to opening edges of these U-shaped conductors.

The inductive element according to the present invention maybe utilized as a single electric component such as an inductor element and a transformer. In addition, for example, this inductive element may be arranged by being combined with other electronic components such as a capacitor and a resistor in an integral form. Otherwise, this inductive element may be alternatively assembled into a module.

In accordance with the present invention, since the U-shaped conductors are formed on the same plane of the core substrate within one time, the restrictions given to the conductor lengths and the sectional areas can be mitigated, so that the narrower conductor patterns can be formed. Also, the inductive elements can be manufactured in a higher efficiency, as compared with such a case that the through holes are formed. As a consequence, it is possible to provide the inductive elements at a lower cost by being manufactured in an easy manner. Also, since the coils are formed in the helical shapes, the Q-factors thereof can be increased.

Also, according to the present invention, there are free degrees as to the element structures and the manufacturing methods, while either the organic material or the inorganic material can be employed as the usable materials, or the composite material made of the organic material and the inorganic material may be employed as the usable materials. Also, the inductive elements having the high-performance electric characteristics optimized to the use purposes can be obtained.

What is claimed is:

1. An inductive element having a first direction, a second direction, and a stacking direction, said inductive element comprising:

a plurality of alternating individual sheets of conducting and insulating layers forming a stack wherein each conducting layer is integrally formed from a solid sheet into a U-shaped conductive layer such that every U-shaped conductive layer is located in a substantially same position along the first direction and the second direction and is located a distance from an adjacent U-shaped conductive layer along the stacking direction;

an embedding material filled in an area between legs of the U-shaped conducting layers; and a bridge conductor which bridges an opening edge of the U-shaped conducting layer to an opening edge of the next U-shaped conducting layer to form a coil, wherein said U-shaped conducting layers are connected by said bridge conductor by skipping one of said U-shaped conducting layers so as to form two sets of rectangular helical coils.

2. An inductive element as claimed in claim 1 wherein said inductive element has an insulating layer which covers a peripheral portion of said coil;

at least one of said insulating layer and said embedding material is constructed of a magnetic material; and the insulating layer between the coil conductors is made of a dielectric material.

3. An inductive element as claimed in claim 1 wherein either said insulating layers are or said embedding material is made of either resin or a composite material which is made by mixing functional material powder into the resin.

4. An inductive element as claimed in claim 1 wherein said U-shaped conducting layers are made of either a metal plate or a metal foil; and said bridge conductor is formed by a photolithography method.

5. An inductive element as claimed in claim 4 wherein said bridge conductor is formed on a flattened surface of both an opening edge of said U-shaped conducting layers and said embedding material which has been embedded in said area.

6. An inductive element having a first direction, a second direction, and a stacking direction, said inductive element comprising:

a stacked core substrate formed by stacking a plurality of core substrates, each core substrate having a U-shaped conductor corresponding to three sides of plural rectangular helical coils, every U-shaped conductive layer being located in a substantially same position along the first direction and the second direction and being located a distance from an adjacent U-shaped conductive layer along the stacking direction;

a bridge conductor which bridges an opening edge of the U-shaped conductor to an opening edge of the next U-shaped conductor to form a coil; and an insulating layer covering said bridge conductors, wherein said U-shaped conductors are connected by said bridge conductor by skipping one of said U-shaped conductors so as to form two sets of rectangular helical coils.

7. An inductive element as claimed in claim 6 wherein said U-shaped conductors of each of said layers are coaxially formed in a multiple manner;

such U-shaped conductors having the same sizes, which are located adjacent to each other along a stacking layer direction, are connected to each other by said bridge conductors; and among the U-shaped conductors which are located adjacent to each other along inner/outer directions, such U-shaped conductors located on the same side edge portions along the stacking larger direction, or the opposite side edge portions along the stacking layer direction are connected to each other by said bridge conductors, whereby rectangular helical coils are formed in a multiple manner.

8. An inductive element as claimed in claim 6 wherein both said stacked core substrate and said insulating layer are made of either resin or a composite material made by mixing functional material powder into the resin.

9. An inductive element as claimed in claim 6 wherein both said U-shaped conductors and said bridge conductors are formed by way of a photolithography method.

10. An inductive element comprising:

a plurality of alternating individual sheets of conducting and insulating layers forming a stack wherein the conducting layers are solid and processed to be U-shaped;

an embedding material filled in an area between legs of the U-shaped conducting layers; and a bridge conductor which bridges the U-shaped conducting layers by skipping one of said U-shaped conducting layers to form two sets of rectangular helical coils.

11. An inductive element as claimed in claim 10 wherein said inductive element has an insulating layer which covers a peripheral portion of said coil;

at least one of said insulating layer and said embedding material is constructed of a magnetic material; and the insulating layer between the coil conductors is made of a dielectric material.

12. An inductive element as claimed in claim 10 wherein said U-shaped conducting layers are made of either a metal plate or a metal foil; and said bridge conductor is formed by a photolithography method.

13. An inductive element as claimed in claim 12 wherein said bridge conductor is formed on a flattened surface of both an opening edge of said U-shaped conducting layers and said embedding material which has been embedded in said area.

14. An inductive element as claimed in claim 10 wherein either said insulating layers are or said embedding material is made of either resin or a composite material which is made by mixing functional material powder into the resin.

* * * * *